US007273099B2

(12) United States Patent
East, Jr. et al.

(10) Patent No.: US 7,273,099 B2
(45) Date of Patent: Sep. 25, 2007

(54) METHODS OF STIMULATING A SUBTERRANEAN FORMATION COMPRISING MULTIPLE PRODUCTION INTERVALS

(75) Inventors: Loyd E. East, Jr., Tomball, TX (US); Travis W. Cavender, Angleton, TX (US); David J. Attaway, Missouri City, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 348 days.

(21) Appl. No.: 11/004,441

(22) Filed: Dec. 3, 2004

(65) Prior Publication Data

US 2006/0118301 A1 Jun. 8, 2006

(51) Int. Cl.
*E21B 43/267* (2006.01)
*E21B 43/114* (2006.01)

(52) U.S. Cl. ..... 166/280.1; 166/281; 166/282; 166/283; 166/292; 166/294; 166/295; 166/298

(58) Field of Classification Search ..... 166/55.1, 166/280.1, 280.2, 281, 282, 283, 285, 292, 166/294, 295, 297, 298, 307, 308.1, 308.2
See application file for complete search history.

(56) References Cited

U.S. PATENT DOCUMENTS

| | | | | |
|---|---|---|---|---|
| 2,238,671 A | | 4/1941 | Woodhouse | 166/21 |
| 2,703,316 A | | 3/1955 | Schneider | 260/78.3 |
| 2,869,642 A | | 1/1959 | McKay et al. | |
| 3,047,067 A | | 7/1962 | Williams et al. | 166/33 |
| 3,123,138 A | | 3/1964 | Robichaux | 166/33 |
| 3,176,768 A | | 4/1965 | Brandt et al. | 166/33 |
| 3,199,590 A | | 8/1965 | Young | 166/33 |
| 3,272,650 A | | 9/1966 | MacVittie | 134/7 |
| 3,297,086 A | | 1/1967 | Spain | 166/33 |
| 3,308,885 A | | 3/1967 | Sandiford | 166/33 |
| 3,316,965 A | | 5/1967 | Watanabe | 166/33 |
| 3,336,980 A | * | 8/1967 | Rike | 166/295 |
| 3,375,872 A | | 4/1968 | McLaughlin et al. | 166/29 |
| 3,404,735 A | | 10/1968 | Young et al. | 166/33 |
| 3,415,320 A | | 12/1968 | Young | 166/33 |

(Continued)

FOREIGN PATENT DOCUMENTS

| | | |
|---|---|---|
| CA | 2063877 | 5/2003 |

(Continued)

OTHER PUBLICATIONS

U.S. Appl. No. 10/864,618 entitled "Aqueous-Based Tackifier Fluids and Methods of Use," by Matthew Eric Blauch, et al.

(Continued)

*Primary Examiner*—George Suchfield
(74) *Attorney, Agent, or Firm*—Robert A. Kent; Fletcher, Yoder & Van Someren

(57) ABSTRACT

A method of stimulating a production interval adjacent a well bore having a casing disposed therein, that comprises introducing a carrier fluid comprising first particulates into the well bore, packing the first particulates into a plurality of perforations in the casing, perforating at least one remedial perforation in the casing adjacent to the production interval, and stimulating the production interval through the at least one remedial perforation. Also provided are methods of stimulating multiple production intervals adjacent a well bore.

59 Claims, 6 Drawing Sheets

U.S. PATENT DOCUMENTS

| | | | | | |
|---|---|---|---|---|---|
| 3,492,147 | A | | 1/1970 | Young et al. | 117/62.2 |
| 3,659,651 | A | | 5/1972 | Graham | 166/280 |
| 3,681,287 | A | | 8/1972 | Brown et al. | 260/67 |
| 3,708,013 | A | * | 1/1973 | Dismukes | 166/276 |
| 3,709,298 | A | * | 1/1973 | Pramann | 166/276 |
| 3,754,598 | A | | 8/1973 | Holloway, Jr. | 166/249 |
| 3,765,804 | A | | 10/1973 | Brandon | 417/540 |
| 3,768,564 | A | | 10/1973 | Knox et al. | 166/307 |
| 3,784,585 | A | | 1/1974 | Schmitt et al. | 260/861 |
| 3,819,525 | A | | 6/1974 | Hattenbrun | 252/132 |
| 3,828,854 | A | | 8/1974 | Templeton et al. | 166/307 |
| 3,842,911 | A | | 10/1974 | Know et al. | 166/307 |
| 3,854,533 | A | | 12/1974 | Gurley et al. | 166/276 |
| 3,857,444 | A | | 12/1974 | Copeland | 166/276 |
| 3,863,709 | A | | 2/1975 | Fitch | 165/1 |
| 3,868,998 | A | | 3/1975 | Lybarger et al. | 166/278 |
| 3,888,311 | A | | 6/1975 | Cooke, Jr. | 166/280 |
| 3,912,692 | A | | 10/1975 | Casey et al. | 260/78.3 |
| 3,948,672 | A | | 4/1976 | Harnberger | 106/90 |
| 3,955,993 | A | | 5/1976 | Curtice | 106/90 |
| 3,960,736 | A | | 6/1976 | Free et al. | 252/8.55 R |
| 3,983,941 | A | * | 10/1976 | Fitch | 166/276 |
| 4,008,763 | A | | 2/1977 | Lowe et al. | 166/253 |
| 4,015,995 | A | | 4/1977 | Hess | 106/287 |
| 4,029,148 | A | | 6/1977 | Emery | 166/250.1 |
| 4,031,958 | A | | 6/1977 | Sandiford et al. | 166/270 |
| 4,042,032 | A | | 8/1977 | Anderson et al. | 166/276 |
| 4,070,865 | A | | 1/1978 | McLaughlin | 61/36 |
| 4,074,760 | A | | 2/1978 | Copeland et al. | 166/276 |
| 4,085,801 | A | | 4/1978 | Sifferman | 166/295 |
| 4,127,173 | A | | 11/1978 | Watkins et al. | 166/276 |
| 4,169,798 | A | | 10/1979 | DeMartino | 252/8.55 R |
| 4,172,066 | A | | 10/1979 | Zweigle et al. | 260/29.6 TA |
| 4,245,702 | A | | 1/1981 | Haafkens et al. | 166/307 |
| 4,273,187 | A | | 6/1981 | Satter et al. | 166/250 |
| 4,291,766 | A | | 9/1981 | Davies et al. | 166/276 |
| 4,305,463 | A | | 12/1981 | Zakiewicz | 106/245 |
| 4,336,842 | A | | 6/1982 | Graham et al. | 166/276 |
| 4,352,674 | A | | 10/1982 | Fery | 23/230 |
| 4,353,806 | A | | 10/1982 | Canter et al. | 507/229 |
| 4,387,769 | A | | 6/1983 | Erbstoesser et al. | 166/295 |
| 4,415,805 | A | | 11/1983 | Fertl et al. | 250/260 |
| 4,439,489 | A | | 3/1984 | Johnson et al. | 428/404 |
| 4,443,347 | A | | 4/1984 | Underdown et al. | 252/8.55 R |
| 4,460,052 | A | | 7/1984 | Gockel | 175/72 |
| 4,470,915 | A | | 9/1984 | Conway | 252/8.55 R |
| 4,493,875 | A | | 1/1985 | Beck et al. | 428/403 |
| 4,494,605 | A | | 1/1985 | Wiechel et al. | 166/288 |
| 4,498,995 | A | | 2/1985 | Gockel | 252/8.5 LC |
| 4,501,328 | A | | 2/1985 | Nichols | 166/288 |
| 4,526,695 | A | | 7/1985 | Erbstosser et al. | 252/8.55 R |
| 4,527,627 | A | | 7/1985 | Graham et al. | 166/280 |
| 4,541,489 | A | | 9/1985 | Wu | 166/312 |
| 4,546,012 | A | | 10/1985 | Brooks | 427/213 |
| 4,553,596 | A | | 11/1985 | Graham et al. | 166/295 |
| 4,564,459 | A | | 1/1986 | Underdown et al. | 252/8.55 R |
| 4,572,803 | A | | 2/1986 | Yamazoe et al. | 534/16 |
| 4,649,998 | A | | 3/1987 | Friedman | 166/294 |
| 4,664,819 | A | | 5/1987 | Glaze et al. | 252/8.551 |
| 4,665,988 | A | | 5/1987 | Murphey et al. | 166/295 |
| 4,669,543 | A | | 6/1987 | Young | 166/276 |
| 4,670,501 | A | | 6/1987 | Dymond et al. | 524/458 |
| 4,675,140 | A | | 6/1987 | Sparks et al. | 264/4.3 |
| 4,681,165 | A | | 7/1987 | Bannister | 166/312 |
| 4,683,954 | A | | 8/1987 | Walker et al. | 166/307 |
| 4,694,905 | A | | 9/1987 | Armbruster | 166/280 |
| 4,715,967 | A | | 12/1987 | Bellis | 252/8.551 |
| 4,716,964 | A | | 1/1988 | Erbstoesser et al. | 166/284 |
| 4,733,729 | A | | 3/1988 | Copeland | 166/276 |
| 4,739,832 | A | | 4/1988 | Jennings, Jr. et al. | 166/299 |
| 4,772,646 | A | | 9/1988 | Harms et al. | 524/27 |
| 4,777,200 | A | | 10/1988 | Dymond et al. | 524/458 |
| 4,785,884 | A | | 11/1988 | Armbruster | 166/280 |
| 4,787,453 | A | | 11/1988 | Hewgill et al. | 166/272.3 |
| 4,789,105 | A | | 12/1988 | Hosokawa et al. | 241/67 |
| 4,796,701 | A | | 1/1989 | Hudson et al. | 166/278 |
| 4,797,262 | A | | 1/1989 | Dewitz | 422/142 |
| 4,800,960 | A | | 1/1989 | Friedman et al. | 166/276 |
| 4,809,783 | A | | 3/1989 | Hollenbeck et al. | 166/307 |
| 4,817,721 | A | | 4/1989 | Pober | 166/295 |
| 4,829,100 | A | | 5/1989 | Murphey et al. | 523/131 |
| 4,838,352 | A | | 6/1989 | Oberste-Padtberg et al. | 166/291 |
| 4,842,072 | A | | 6/1989 | Friedman et al. | 166/295 |
| 4,843,118 | A | | 6/1989 | Lai et al. | 524/555 |
| 4,848,467 | A | | 7/1989 | Cantu et al. | 166/281 |
| 4,848,470 | A | | 7/1989 | Korpics | 166/312 |
| 4,850,430 | A | | 7/1989 | Copeland et al. | 166/276 |
| 4,856,590 | A | * | 8/1989 | Caillier | 166/278 |
| 4,886,354 | A | | 12/1989 | Welch et al. | 356/70 |
| 4,888,240 | A | | 12/1989 | Graham et al. | 428/403 |
| 4,895,207 | A | | 1/1990 | Friedman et al. | 166/276 |
| 4,903,770 | A | | 2/1990 | Friedman et al. | 166/288 |
| 4,934,456 | A | | 6/1990 | Moradi-Araghi | 166/270 |
| 4,936,385 | A | | 6/1990 | Weaver et al. | 166/288 |
| 4,942,186 | A | | 7/1990 | Murphey et al. | 523/131 |
| 4,957,165 | A | | 9/1990 | Cantu et al. | 166/295 |
| 4,959,432 | A | | 9/1990 | Fan et al. | 526/287 |
| 4,961,466 | A | | 10/1990 | Himes et al. | 166/250 |
| 4,969,522 | A | | 11/1990 | Whitehurst et al. | 166/278 |
| 4,969,523 | A | | 11/1990 | Martin et al. | 166/278 |
| 4,986,353 | A | | 1/1991 | Clark et al. | 166/279 |
| 4,986,354 | A | | 1/1991 | Cantu et al. | 166/279 |
| 4,986,355 | A | | 1/1991 | Casad et al. | 166/295 |
| 5,030,603 | A | | 7/1991 | Rumpf et al. | 501/127 |
| 5,049,743 | A | | 9/1991 | Taylor, III et al. | 250/303 |
| 5,082,056 | A | | 1/1992 | Tackett, Jr. | 166/295 |
| 5,095,987 | A | | 3/1992 | Weaver et al. | 166/276 |
| 5,105,886 | A | * | 4/1992 | Strubhar et al. | 166/280.1 |
| 5,107,928 | A | | 4/1992 | Hilterhaus | 166/293 |
| 5,128,390 | A | | 7/1992 | Murphey et al. | 523/130 |
| 5,135,051 | A | | 8/1992 | Fracteau et al. | 166/104 |
| 5,142,023 | A | | 8/1992 | Gruber et al. | 528/354 |
| 5,165,438 | A | | 11/1992 | Fracteau et al. | 137/1 |
| 5,173,527 | A | | 12/1992 | Calve | 524/74 |
| 5,178,218 | A | | 1/1993 | Dees | 166/281 |
| 5,182,051 | A | | 1/1993 | Bandy et al. | 252/645 |
| 5,199,491 | A | | 4/1993 | Kutts et al. | 166/276 |
| 5,199,492 | A | | 4/1993 | Surles et al. | 166/295 |
| 5,211,234 | A | | 5/1993 | Floyd | 166/276 |
| 5,216,050 | A | | 6/1993 | Sinclair | 524/108 |
| 5,218,038 | A | | 6/1993 | Johnson et al. | 524/541 |
| 5,232,955 | A | | 8/1993 | Caabai et al. | 521/63 |
| 5,232,961 | A | | 8/1993 | Murphey et al. | 523/414 |
| 5,238,068 | A | | 8/1993 | Fredickson | 166/307 |
| 5,247,059 | A | | 9/1993 | Gruber et al. | 528/354 |
| 5,249,627 | A | | 10/1993 | Harms et al. | 166/308 |
| 5,249,628 | A | | 10/1993 | Surjaatmadja | 166/305 |
| 5,256,729 | A | | 10/1993 | Kutts et al. | 524/700 |
| 5,265,678 | A | | 11/1993 | Grundmann | |
| 5,273,115 | A | | 12/1993 | Spafford | 166/281 |
| 5,278,203 | A | | 1/1994 | Harms | 523/200 |
| 5,285,849 | A | | 2/1994 | Surles et al. | 166/295 |
| 5,293,939 | A | | 3/1994 | Surles et al. | 166/295 |
| 5,295,542 | A | | 3/1994 | Cole et al. | 166/278 |
| 5,320,171 | A | | 6/1994 | Laramay | 166/285 |
| 5,321,062 | A | | 6/1994 | Landrum et al. | 523/141 |
| 5,325,923 | A | | 7/1994 | Surjaatmadja et al. | 166/308 |
| 5,330,005 | A | | 7/1994 | Card et al. | 166/280 |
| 5,332,037 | A | | 7/1994 | Schmidt et al. | 166/276 |
| 5,335,726 | A | | 8/1994 | Rodrogues | 166/295 |
| 5,351,754 | A | | 10/1994 | Hardin et al. | 166/249 |
| 5,358,051 | A | | 10/1994 | Rodrigues | 166/295 |
| 5,359,026 | A | | 10/1994 | Gruber | 528/354 |

5,360,068 A 11/1994 Sprunt et al. ..... 166/259
5,361,856 A 11/1994 Surjaatmajda et al. ..... 175/67
5,363,916 A 11/1994 Himes et al. ..... 166/276
5,373,901 A 12/1994 Norman et al. ..... 166/300
5,377,759 A 1/1995 Surles ..... 166/295
5,381,864 A 1/1995 Nguyen et al. ..... 166/280
5,386,874 A 2/1995 Laramay et al. ..... 166/300
5,388,648 A 2/1995 Jordan, Jr. ..... 166/380
5,390,741 A 2/1995 Payton et al.
5,393,810 A 2/1995 Harris et al. ..... 524/56
5,396,957 A 3/1995 Surjaatmadja et al. ..... 166/308
5,402,846 A 4/1995 Jennings, Jr. et al. ..... 166/259
5,422,183 A 6/1995 Sinclair et al. ..... 428/403
5,423,381 A 6/1995 Surles et al. ..... 166/295
5,439,055 A 8/1995 Card et al. ..... 166/280
5,460,226 A 10/1995 Lawton et al. ..... 166/300
5,464,060 A 11/1995 Hale et al. ..... 166/293
5,475,080 A 12/1995 Gruber et al. ..... 528/354
5,484,881 A 1/1996 Gruber et al. ..... 528/54
5,492,178 A 2/1996 Nguyen et al. ..... 166/276
5,494,103 A 2/1996 Surjaatmadja et al. ..... 166/222
5,497,830 A 3/1996 Boles et al. ..... 166/300
5,498,280 A 3/1996 Fistner et al. ..... 106/19
5,499,678 A 3/1996 Surjaatmadja et al. ..... 166/298
5,501,274 A 3/1996 Nguyen et al. ..... 166/276
5,501,275 A 3/1996 Card et al. ..... 166/280
5,505,787 A 4/1996 Yamaguchi ..... 134/4
5,512,071 A 4/1996 Yam et al. ..... 51/307
5,520,250 A 5/1996 Harry et al. ..... 166/278
5,522,460 A 6/1996 Shu ..... 166/295
5,529,123 A 6/1996 Carpenter et al. ..... 166/293
5,531,274 A 7/1996 Bienvenu, Jr. ..... 166/280
5,536,807 A 7/1996 Gruber et al. ..... 528/354
5,545,824 A 8/1996 Stengel et al. ..... 524/590
5,547,023 A 8/1996 McDaniel et al. ..... 166/280
5,551,513 A 9/1996 Suries et al. ..... 166/278
5,551,514 A 9/1996 Nelson et al. ..... 166/280
5,582,249 A 12/1996 Caveny et al. ..... 166/276
5,582,250 A 12/1996 Constein ..... 166/280
5,588,488 A 12/1996 Vijn et al. ..... 166/293
5,591,700 A 1/1997 Harris et al. ..... 507/204
5,594,095 A 1/1997 Gruber et al. ..... 528/354
5,595,245 A 1/1997 Scott, III ..... 166/250.1
5,597,784 A 1/1997 Sinclair et al. ..... 507/229
5,604,184 A 2/1997 Ellis et al. ..... 507/117
5,604,186 A 2/1997 Hunt et al. ..... 507/204
5,609,207 A 3/1997 Dewprashad et al. ..... 166/276
5,620,049 A 4/1997 Gipson et al. ..... 166/248
5,639,806 A 6/1997 Johnson et al. ..... 523/208
5,669,448 A 9/1997 Minthorn et al. ..... 166/308
5,670,473 A 9/1997 Scepanski ..... 510/445
5,692,566 A 12/1997 Surles ..... 166/295
5,697,440 A 12/1997 Weaver et al. ..... 166/281
5,698,322 A 12/1997 Tsai et al. ..... 428/373
5,704,426 A * 1/1998 Rytlewski et al. ..... 166/297
5,712,314 A 1/1998 Surles et al. ..... 521/41
5,732,364 A 3/1998 Kalb et al. ..... 588/8
5,765,642 A 6/1998 Surjaatmadja
5,775,425 A 7/1998 Weaver et al. ..... 166/276
5,782,300 A 7/1998 James et al. ..... 166/278
5,783,822 A 7/1998 Buchanan et al. ..... 250/259
5,787,986 A 8/1998 Weaver et al. ..... 166/280
5,791,415 A 8/1998 Nguyen et al. ..... 166/280
5,799,734 A 9/1998 Norman et al. ..... 166/278
5,806,593 A 9/1998 Suries ..... 166/270
5,830,987 A 11/1998 Smith ..... 528/332
5,833,000 A 11/1998 Weaver et al.
5,833,361 A 11/1998 Funk ..... 366/80
5,836,391 A 11/1998 Jonasson et al. ..... 166/295
5,836,392 A 11/1998 Urlwin-Smith ..... 166/295
5,837,656 A 11/1998 Sinclair et al. ..... 507/220
5,837,785 A 11/1998 Kinsho et al. ..... 525/527
5,839,510 A 11/1998 Weaver et al.
5,840,784 A 11/1998 Funkhouser et al. ..... 523/130
5,849,401 A 12/1998 El-Afandi et al. ..... 428/215
5,849,590 A 12/1998 Anderson, II et al. ..... 436/27
5,853,048 A 12/1998 Weaver et al.
5,864,003 A 1/1999 Qureshi et al. ..... 528/141
5,865,936 A 2/1999 Edelman et al. ..... 156/310
5,871,049 A 2/1999 Weaver et al. ..... 166/276
5,873,413 A 2/1999 Chatterji et al. ..... 166/293
5,875,844 A 3/1999 Chatterji et al. ..... 166/293
5,875,845 A 3/1999 Chatterji et al. ..... 166/293
5,875,846 A 3/1999 Chatterji et al. ..... 166/293
5,893,383 A 4/1999 Fracteau ..... 137/14
5,893,416 A 4/1999 Read ..... 166/304
5,908,073 A 6/1999 Nguyen et al. ..... 166/276
5,911,282 A 6/1999 Onan et al. ..... 175/72
5,916,933 A 6/1999 Johnson et al. ..... 523/208
5,921,317 A 7/1999 Dewprashad et al. ..... 166/208
5,924,488 A 7/1999 Nguyen et al. ..... 166/280
5,929,437 A 7/1999 Elliott et al. ..... 250/259
5,944,105 A 8/1999 Nguyen ..... 166/278
5,945,387 A 8/1999 Chatterji et al. ..... 507/224
5,948,734 A 9/1999 Sinclair et al. ..... 507/219
5,957,204 A 9/1999 Chatterji et al. ..... 166/295
5,960,877 A 10/1999 Funkhouser et al. ..... 166/270
5,960,878 A 10/1999 Nguyen et al. ..... 166/276
5,960,880 A 10/1999 Nguyen et al. ..... 166/280
5,964,291 A 10/1999 Bourne et al. ..... 166/279
5,969,006 A 10/1999 Onan et al. ..... 523/166
5,977,283 A 11/1999 Rossitto ..... 528/44
5,994,785 A 11/1999 Higuchi et al. ..... 527/789
RE36,466 E 12/1999 Nelson et al. ..... 166/280
6,003,600 A 12/1999 Nguyen et al. ..... 166/281
6,004,400 A 12/1999 Bishop et al. ..... 134/2
6,006,835 A 12/1999 Onan et al. ..... 166/295
6,006,836 A 12/1999 Chatterji et al. ..... 166/295
6,006,838 A 12/1999 Whiteley et al. ..... 166/306
6,012,524 A 1/2000 Chatterji et al. ..... 166/295
6,016,870 A 1/2000 Dewprashad et al. ..... 166/295
6,024,170 A 2/2000 McCabe et al. ..... 166/300
6,028,113 A 2/2000 Scepanski ..... 514/643
6,028,534 A 2/2000 Ciglenec et al. ..... 340/856.2
6,040,398 A 3/2000 Kinsho et al. ..... 525/527
6,047,772 A 4/2000 Weaver et al. ..... 166/276
6,059,034 A 5/2000 Rickards et al. ..... 166/280
6,059,035 A 5/2000 Chatterji et al. ..... 166/293
6,059,036 A 5/2000 Chatterji et al. ..... 166/294
6,068,055 A 5/2000 Chatterji et al. ..... 166/293
6,069,117 A 5/2000 Onan et al. ..... 507/202
6,074,739 A 6/2000 Katagiri ..... 428/323
6,079,492 A 6/2000 Hoogteijling et al. ..... 166/276
6,098,711 A 8/2000 Chatterji et al. ..... 166/294
6,114,410 A 9/2000 Betzold ..... 523/130
6,123,871 A 9/2000 Carroll ..... 252/301.36
6,123,965 A 9/2000 Jacon et al. ..... 424/489
6,124,246 A 9/2000 Heathman et al. ..... 507/219
6,130,286 A 10/2000 Thomas et al. ..... 524/507
6,135,987 A 10/2000 Tsai et al. ..... 604/365
6,140,446 A 10/2000 Fujiki et al. ..... 528/15
6,148,911 A 11/2000 Gipson et al. ..... 166/248
6,152,234 A 11/2000 Newhouse et al. ..... 166/403
6,162,766 A 12/2000 Muir et al. ..... 507/267
6,169,058 B1 1/2001 Le et al. ..... 507/222
6,172,011 B1 1/2001 Card et al. ..... 507/204
6,172,077 B1 1/2001 Curtis et al. ..... 514/278
6,176,315 B1 1/2001 Reddy et al. ..... 166/295
6,177,484 B1 1/2001 Surles ..... 523/131
6,184,311 B1 2/2001 O'Keefe et al. ..... 525/438
6,187,834 B1 2/2001 Thayer et al. ..... 522/15
6,187,839 B1 2/2001 Eoff et al. ..... 523/130
6,189,615 B1 2/2001 Sydansk ..... 166/270
6,192,985 B1 2/2001 Hinkel et al. ..... 166/280
6,192,986 B1 2/2001 Urlwin-Smith ..... 166/295
6,196,317 B1 3/2001 Hardy ..... 166/295

6,202,751 B1 3/2001 Chatterji et al. ..... 166/276
6,209,643 B1 4/2001 Nguyen et al. ..... 166/276
6,209,644 B1 4/2001 Brunet ..... 166/297
6,209,646 B1 4/2001 Reddy et al. ..... 166/300
6,210,471 B1 4/2001 Craig ..... 106/31.08
6,214,773 B1 4/2001 Harris et al. ..... 507/271
6,231,664 B1 5/2001 Chatterji et al. ..... 106/724
6,234,251 B1 5/2001 Chatterji et al. ..... 166/295
6,238,597 B1 5/2001 Yim et al. ..... 252/512
6,241,019 B1 6/2001 Davidson et al. ..... 166/249
6,242,390 B1 6/2001 Mitchell et al. ..... 507/211
6,244,344 B1 6/2001 Chatterji et al. ..... 166/295
6,253,851 B1 * 7/2001 Schroeder et al. ..... 166/278
6,257,335 B1 7/2001 Nguyen et al. ..... 166/280
6,260,622 B1 7/2001 Blok et al. ..... 166/305.1
6,271,181 B1 8/2001 Chatterji et al. ..... 507/219
6,274,650 B1 8/2001 Cui ..... 523/457
6,279,652 B1 8/2001 Chatterji et al. ..... 166/194
6,279,656 B1 8/2001 Sinclair et al. ..... 166/310
6,283,214 B1 9/2001 Guinot et al. ..... 166/297
6,302,207 B1 10/2001 Nguyen et al. ..... 166/276
6,306,998 B1 10/2001 Kimura et al. ..... 528/12
6,311,773 B1 11/2001 Todd et al. ..... 166/280
6,321,841 B1 11/2001 Eoff et al. ..... 166/291
6,323,307 B1 11/2001 Bigg et al. ..... 528/354
6,326,458 B1 12/2001 Gruber et al. ..... 528/354
6,328,105 B1 12/2001 Betzold ..... 166/280
6,328,106 B1 12/2001 Griffith et al. ..... 166/295
6,330,916 B1 12/2001 Rickards et al. ..... 166/280
6,330,917 B2 12/2001 Chatterji et al. ..... 166/295
6,350,309 B2 2/2002 Chatterji et al. ..... 106/677
6,357,527 B1 3/2002 Norman et al. ..... 166/300
6,364,018 B1 4/2002 Brannon et al. ..... 166/280.2
6,364,945 B1 4/2002 Chatterji et al. ..... 106/677
6,367,165 B1 4/2002 Huttlin ..... 34/582
6,367,549 B1 4/2002 Chatterji et al. ..... 166/292
6,372,678 B1 4/2002 Youngsman et al. ..... 504/128
6,376,571 B1 4/2002 Chawla et al. ..... 522/64
6,387,986 B1 5/2002 Moradi-Araghi et al. ... 523/211
6,390,195 B1 5/2002 Nguyen et al. ..... 166/276
6,401,817 B1 6/2002 Griffith et al. ..... 166/295
6,405,797 B2 6/2002 Davidson et al. ..... 166/249
6,406,789 B1 6/2002 McDaniel et al. ..... 428/403
6,408,943 B1 6/2002 Schultz et al. ..... 166/285
6,422,314 B1 7/2002 Todd et al. ..... 166/312
6,439,309 B1 8/2002 Matherly et al.
6,439,310 B1 8/2002 Scott, III et al. ..... 166/308
6,440,255 B1 8/2002 Kohlhammer et al. ..... 156/283
6,446,727 B1 9/2002 Zemlak et al.
6,448,206 B1 9/2002 Griffith et al. ..... 507/219
6,450,260 B1 9/2002 James et al. ..... 166/277
6,454,003 B1 9/2002 Chang et al. ..... 166/270
6,458,885 B1 10/2002 Stengal et al. ..... 524/507
6,485,947 B1 11/2002 Rajgarhia et al. ..... 435/139
6,488,091 B1 12/2002 Weaver et al. ..... 166/300
6,488,763 B2 12/2002 Brothers et al. ..... 106/692
6,494,263 B2 12/2002 Todd ..... 166/312
6,503,870 B2 1/2003 Griffith et al. ..... 507/219
6,508,305 B1 1/2003 Brannon et al. ..... 166/293
6,520,255 B2 2/2003 Tolman et al.
6,527,051 B1 3/2003 Reddy et al. ..... 166/300
6,528,157 B1 3/2003 Hussain et al. ..... 428/325
6,531,427 B1 3/2003 Shuchart et al. ..... 507/267
6,534,449 B1 3/2003 Gilmour et al. ..... 507/203
6,538,576 B1 3/2003 Schultz et al. ..... 340/859.6
6,543,545 B1 4/2003 Chatterji et al. ..... 166/381
6,552,333 B1 4/2003 Storm et al. ..... 250/269.3
6,554,071 B1 4/2003 Reddy et al. ..... 166/293
6,555,507 B2 4/2003 Chatterji et al. ..... 507/219
6,569,814 B1 5/2003 Brady et al. ..... 507/201
6,582,819 B2 6/2003 McDaniel et al. ..... 428/402
6,593,402 B2 7/2003 Chatterji et al. ..... 524/7
6,599,863 B1 7/2003 Palmer et al. ..... 507/219
6,601,648 B2 * 8/2003 Ebinger ..... 166/297
6,608,162 B1 8/2003 Chiu et al. ..... 528/129
6,616,320 B2 9/2003 Huber et al. ..... 366/156.2
6,620,857 B2 9/2003 Valet ..... 522/42
6,626,241 B2 * 9/2003 Nguyen ..... 166/278
6,632,527 B1 10/2003 McDaniel et al. ..... 428/402
6,632,892 B2 10/2003 Rubinsztajn et al. ..... 525/476
6,642,309 B2 11/2003 Komitsu et al. ..... 525/100
6,648,501 B2 11/2003 Huber et al. ..... 366/301
6,659,179 B2 12/2003 Nguyen ..... 166/227
6,664,343 B2 12/2003 Narisawa et al. ..... 525/474
6,667,279 B1 12/2003 Hessert et al. ..... 507/225
6,668,926 B2 12/2003 Nguyen et al. ..... 166/280
6,669,771 B2 12/2003 Tokiwa et al. ..... 106/162.7
6,681,856 B1 1/2004 Chatterji et al. ..... 166/294
6,686,328 B1 2/2004 Binder ..... 510/446
6,705,400 B1 3/2004 Nguyen et al. ..... 166/281
6,710,019 B1 3/2004 Sawdon et al. ..... 507/136
6,713,170 B1 3/2004 Kaneka et al. ..... 428/323
6,725,926 B2 4/2004 Nguyen et al. ..... 166/254.1
6,725,931 B2 4/2004 Nguyen et al. ..... 166/280.2
6,729,404 B2 5/2004 Nguyen et al. ..... 166/280.2
6,732,800 B2 5/2004 Acock et al. ..... 166/308
6,745,159 B1 6/2004 Todd et al. ..... 703/10
6,749,025 B1 6/2004 Brannon et al. ..... 166/305.1
6,763,888 B1 7/2004 Harris et al. ..... 166/305.1
6,766,858 B2 7/2004 Nguyen et al. ..... 166/300
6,776,236 B1 8/2004 Nguyen ..... 166/279
6,832,650 B2 12/2004 Nguyen et al. ..... 166/279
6,851,474 B2 2/2005 Nguyen ..... 166/279
6,887,834 B2 5/2005 Nguyen et al. ..... 507/221
6,962,203 B2 * 11/2005 Funchess ..... 166/297
6,978,836 B2 12/2005 Nguyen et al. ..... 166/295
2001/0016562 A1 8/2001 Muir et al. ..... 507/201
2002/0043370 A1 4/2002 Poe ..... 166/250.07
2002/0048676 A1 4/2002 McDaniel et al. ..... 428/404
2002/0070020 A1 6/2002 Nguyen ..... 166/295
2003/0006036 A1 1/2003 Malone et al. ..... 166/250.12
2003/0051876 A1 3/2003 Tolman et al. ..... 166/313
2003/0060374 A1 3/2003 Cooke, Jr. ..... 507/200
2003/0114314 A1 6/2003 Ballard et al. ..... 507/100
2003/0130133 A1 7/2003 Vollmer ..... 507/100
2003/0131999 A1 7/2003 Nguyen et al. ..... 166/280
2003/0148893 A1 8/2003 Lungofer et al. ..... 507/200
2003/0186820 A1 10/2003 Thesing ..... 507/200
2003/0188766 A1 10/2003 Banerjee et al. ..... 134/7
2003/0188872 A1 10/2003 Nguyen et al. ..... 166/308
2003/0196805 A1 10/2003 Boney et al. ..... 166/280
2003/0205376 A1 11/2003 Ayoub et al. ..... 166/254.2
2003/0230408 A1 12/2003 Acock et al. ..... 166/297
2003/0234103 A1 12/2003 Lee et al. ..... 166/293
2004/0000402 A1 1/2004 Nguyen et al. ..... 166/280
2004/0014607 A1 1/2004 Sinclair et al. ..... 507/200
2004/0014608 A1 1/2004 Nguyen et al. ..... 507/200
2004/0040706 A1 3/2004 Hossaini et al. ..... 166/278
2004/0040708 A1 3/2004 Stephenson et al. ..... 166/280.1
2004/0040713 A1 3/2004 Nguyen et al. ..... 166/295
2004/0048752 A1 3/2004 Nguyen et al. ..... 507/269
2004/0055747 A1 3/2004 Lee ..... 166/278
2004/0106525 A1 6/2004 Willbert et al. ..... 507/200
2004/0138068 A1 7/2004 Rimmer et al. ..... 507/100
2004/0149441 A1 8/2004 Nguyen et al. ..... 166/280.1
2004/0152601 A1 8/2004 Still et al. ..... 507/100
2004/0177961 A1 9/2004 Nguyen et al. ..... 166/280.2
2004/0194961 A1 10/2004 Nguyen et al. ..... 166/295
2004/0206499 A1 10/2004 Nguyen et al. ..... 166/280.2
2004/0211559 A1 10/2004 Nguyen et al. ..... 166/276
2004/0211561 A1 10/2004 Nguyen et al. ..... 166/280.2
2004/0221992 A1 11/2004 Nguyen et al. ..... 166/295
2004/0231845 A1 11/2004 Cooke, Jr. ..... 166/279
2004/0231847 A1 11/2004 Nguyen et al. ..... 166/295
2004/0256099 A1 12/2004 Nguyen et al. ..... 166/249
2004/0261995 A1 12/2004 Nguyen et al. ..... 166/279

| | | | | |
|---|---|---|---|---|
| 2004/0261997 | A1 | 12/2004 | Nguyen et al. | 166/281 |
| 2005/0000731 | A1 | 1/2005 | Nguyen et al. | 175/57 |
| 2005/0006093 | A1 | 1/2005 | Nguyen et al. | 166/281 |
| 2005/0006095 | A1 | 1/2005 | Justus et al. | 166/295 |
| 2005/0006096 | A1 | 1/2005 | Nguyen et al. | 166/295 |
| 2005/0034862 | A1 | 2/2005 | Nguyen et al. | 166/281 |
| 2005/0045326 | A1 | 3/2005 | Nguyen | 166/278 |

FOREIGN PATENT DOCUMENTS

| | | | |
|---|---|---|---|
| EP | 0313243 | B1 | 10/1988 |
| EP | 0528595 | A1 | 8/1992 |
| EP | 0510762 | A2 | 11/1992 |
| EP | 0643196 | A2 | 6/1994 |
| EP | 0834644 | A2 | 4/1998 |
| EP | 0853186 | A2 | 7/1998 |
| EP | 0864726 | A2 | 9/1998 |
| EP | 0879935 | B1 | 11/1998 |
| EP | 0933498 | A1 | 8/1999 |
| EP | 1001133 | A1 | 5/2000 |
| EP | 1132569 | A2 | 9/2001 |
| EP | 1326003 | A1 | 7/2003 |
| EP | 1362978 | A1 | 11/2003 |
| EP | 1394355 | A1 | 3/2004 |
| EP | 1396606 | A2 | 3/2004 |
| EP | 1398460 | A1 | 3/2004 |
| EP | 1403466 | A2 | 3/2004 |
| EP | 1464789 | A1 | 10/2004 |
| GB | 1107584 | | 3/1968 |
| GB | 1264180 | | 12/1969 |
| GB | 1292718 | | 10/1972 |
| GB | 2382143 | A | 4/2001 |
| WO | WO93/15127 | | 8/1993 |
| WO | WO94/07949 | | 4/1994 |
| WO | WO94/08078 | | 4/1994 |
| WO | WO94/08090 | | 4/1994 |
| WO | WO95/09879 | | 4/1995 |
| WO | WO97/11845 | | 4/1997 |
| WO | WO99/27229 | | 6/1999 |
| WO | WO 01/81914 | | 11/2001 |
| WO | WO 01/87797 | A1 | 11/2001 |
| WO | WO 02/12674 | A1 | 2/2002 |
| WO | WO 03/027431 | A2 | 4/2003 |
| WO | WO 2004/037946 | A1 | 5/2004 |
| WO | WO 2004/038176 | A1 | 5/2004 |
| WO | WO 2005/021928 | A2 | 3/2005 |

OTHER PUBLICATIONS

"Santrol Bioballs"; http://www.fairmounminerals.com/_SANTROL/SANTROL%20Web%20Site/B_TD.htm.
U.S. Appl. No. 10/383,154, filed Mar. 6, 2003, Nguyen et al.
U.S. Appl. No. 10/394,898, filed Mar. 21, 2003, Eoff et al.
U.S. Appl. No. 10/408,800, filed Apr. 7, 2003, Nguyen et al.
U.S. Appl. No. 10/601,407, filed Jun. 23, 2003, Byrd et al.
U.S. Appl. No. 10/603,492, filed Jun. 25, 2003, Nguyen et al.
U.S. Appl. No. 10/649,029, filed Aug. 27, 2003, Nguyen et al.
U.S. Appl. No. 10/650,063, filed Aug. 26, 2003, Nguyen.
U.S. Appl. No. 10/650,064, filed Aug. 26, 2003, Nguyen et al.
U.S. Appl. No. 10/650,065, filed Aug. 26, 2003, Nguyen.
U.S. Appl. No. 10/659,574, filed Sep. 10, 2003, Nguyen et al.
U.S. Appl. No. 10/727,365, filed Dec. 4, 2003, Reddy et al.
U.S. Appl. No. 10/751,593, filed Jan. 5, 2004, Nguyen.
U.S. Appl. No. 10/775,347, filed Feb. 10, 2004, Nguyen.
U.S. Appl. No. 10/791,944, filed Mar. 3, 2004, Nguyen.
U.S. Appl. No. 10/793,711, filed Mar. 5, 2004, Nguyen et al.
U.S. Appl. No. 10/852,811, filed May 25, 2004, Nguyen.
U.S. Appl. No. 10/853,879, filed May 26, 2004, Nguyen et al.
U.S. Appl. No. 10/860,951, filed Jun. 4, 2004, Stegent et al.
U.S. Appl. No. 10/861,829, filed Jun. 4, 2004, Stegent et al.
U.S. Appl. No. 10/862,986, filed Jun. 8, 2004, Nguyen et al.
U.S. Appl. No. 10/864,061, filed Jun. 9, 2004, Blauch et al.
U.S. Appl. No. 10/868,593, filed Jun. 15, 2004, Nguyen et al.
U.S. Appl. No. 10/868,608, filed Jun. 15, 2004, Nguyen et al.
U.S. Appl. No. 10/937,076, filed Sep. 9, 2004, Nguyen et al.
U.S. Appl. No. 10/944,973, filed Sep. 20, 2004, Nguyen et al.
U.S. Appl. No. 10/972,648, filed Oct. 25, 2004, Dusterhoft et al.
U.S. Appl. No. 10/977,673, filed Oct. 29, 2004, Nguyen.
U.S. Appl. No. 11/009,277, filed Dec. 8, 2004, Welton et al.
U.S. Appl. No. 11/011,394, filed Dec. 12, 2004, Nguyen et al.
U.S. Appl. No. 11/035,833, filed Jan. 14, 2005, Nguyen.
U.S. Appl. No. 11/049,252, filed Feb. 2, 2005, Van Batenburg et al.
U.S. Appl. No. 11/053,280, filed Feb. 8, 2005, Nguyen.
U.S. Appl. No. 11/056,635, filed Feb. 11, 2005.
Halliburton, *CoalStim$^{SM}$ Service, Helps Boost Cash Flow From CBM Assets*, Stimulation, HO3679 Oct. 2003, Halliburton Communications.
Halliburton, *Conductivity Endurance Technology For High Permeability Reservoirs, Helps Prevent Intrusion of Formation Material Into the Proppant Pack for Improved Long-term Production*, Stimulation, 2003, Halliburton Communications.
Halliburton, *Expedite® Service, A Step-Change Improvement Over Conventional Proppant Flowback Control Systems. Provides Up to Three Times the Conductivity of RCPs.*, Stimulation, HO3296 May 2004, Halliburton Communications.
Halliburton Technical Flier—Multi Stage Frac Completion Methods, 2 pages.
Halliburton "*CobraFrac$^{SM}$ Service, Coiled Tubing Fracturing—Cost-Effective Method for Stimulating Untapped Reserves*", 2 pages, 2004.
Halliburton "*CobraJetFrac$^{SM}$ Service, Cost-Effective Technology That Can Help Reduce Cost per BOE Produced, Shorten Cycle time and Reduce Capex*".
Halliburton Cobra Frac Advertisement, 2001.
Halliburton "*SurgiFrac$^{SM}$ Service, a Quick and cost-Effective Method to Help Boost Production From Openhole Horizonal Completions*", 2002.
Halliburton, *SandWedge® NT Conductivity Enhancement System, Enhances Proppant Pack Conductivity and Helps Prevent Intrusion of Formation Material for Improved Long-Term Production*, Stimulation, HO2289 May 2004, Halliburton Communications.
Almond et al., *Factors Affecting Proppant Flowback With Resin Coated Proppants*, SPE 30096, pp. 171-186, May 1995.
Nguyen et al., *A Novel Approach For Enhancing Proppant Consolidation: Laboratory Testing And Field Applications*, SPE Paper No. 77748, 2002.
SPE 15547, *Field Application of Lignosulfonate Gels To Reduce Channeling*, South Swan Hills Miscible Unit, Alberta, Canada, by O.R. Wagner et al., 1986.
Owens et al., *Waterflood Pressure Pulsing for Fractured Reservoirs* SPE 1123, 1966.
Felsenthal et al., *Pressure Pulsing—An Improved Method of Waterflooding Fractured Reservoirs* SPE 1788, 1957.
Raza, "*Water and Gas Cyclic Pulsing Method for Improved Oil Recovery*", SPE 3005, 1971.
Peng et al., "*Pressure Pulsing Waterflooding in Dual Porosity Naturally Fractured Reservoirs*" SPE 17587, 1988.
Dusseault et al, "*Pressure Pulse Workovers in Heavy* Oil", SPE 79033, 2002.
Yang et al., "*Experimental Study on Fracture Initiation By Pressure Pulse*", SPE 63035, 2000.
Nguyen et al., *New Guidelines For Applying Curable Resin-Coated Proppants*, SPE Paper No. 39582, 1997.
Kazakov et al., "*Optimizing and Managing Coiled Tubing Frac Strings*" SPE 60747, 2000.
Advances in Polymer Science, vol. 157, "*Degradable Aliphatic Polyesters*" edited by A.-C. Alberston, pp. 1-138, 2001.
Gorman, *Plastic Electric: Lining up the Future of Conducting Polymers* Science News, vol. 163, May 17, 2003.
Gidley et al., "*Recent Advances in Hydraulic Fracturing*," Chapter 6, pp. 109-130, 1989.
Simmons et al., "*Poly(phenyllactide): Synthesis, Characterization, and Hydrolytic Degradation, Biomacromolecules*", vol. 2, No. 2, pp. 658-663, 2001.
Yin et al., "*Preparation and Characterization of Substituted Polylactides*", Americal Chemical Society, vol. 32, No. 23, pp. 7711-7718, 1999.

Yin et al., "*Synthesis and Properties of Polymers Derived from Substituted Lactic Acids*", American Chemical Society, Ch.12, pp. 147-159, 2001.
Cantu et al., "*Laboratory and Field Evaluation of a Combined Fluid-Loss Control Additive and Gel Breaker for Fracturing Fluids*," SPE 18211, 1990.
Love et al., "*Selectively Placing Many Fractures in Openhole Horizontal Wells Improves Production*", SPE 50422, 1998.
McDaniel et al. "*Evolving New Stimulation Process Proves Highly Effective In Level 1 Dual-Lateral Completion*" SPE 78697, 2002.
Dechy-Cabaret et al., "*Controlled Ring-Operated Polymerization of Lactide and Glycolide*" American Chemical Society, Chemical Reviews, A-Z, AA-AD, 2004.
Funkhouser et al., "*Synthetic Polymer Fracturing Fluid For High-Temperature Applications*", SPE 80236, 2003.
*Chelating Agents*, Encyclopedia of Chemical Technology, vol. 5 (764-795).
Vichaibun et al., "*A New Assay for the Enzymatic Degradation of Polylactic Acid, Short Report*", ScienceAsia, vol. 29, pp. 297-300, 2003.
CDX Gas, CDX Solution, 2003, CDX, LLC, Available @ www.cdxgas.com/solution.html, printed pp. 1-2.
CDX Gas, "*What is Coalbed Methane*?" CDX, LLC. Available @ www.cdxgas.com/what.html, printed p. 1.
Halliburton brochure entitled "H2Zero™ Service Introducing The Next Generation of cost-Effective Conformance Control Solutions", 2002.
Halliburton brochure entitled " "INJECTROL® A Component, 1999.
Halliburton brochure entitled "INJECTROL® G Sealant", 1999.
Halliburton brochure entitled "INJECTROL® IT Sealant", 1999.
Halliburton brochure entitled "INJECTROL® Service Treatment", 1999.
Halliburton brochure entitled "INJECTROL® U Sealant", 1999.
Halliburton brochure entitled "Sanfix® A Resin", 1999.
Halliburton brochure entitled "Pillar Frac Stimulation Technique" Fracturing Services Technical Data Sheet, 2 pages.
Attia, Yosry et al, *Adsorption Thermodynamics Of A Hydrophobic Polymeric Flocculant On Hydrophobic Colloidal Coal Particles*,Langmuir 1991, 7, pp. 2203-2207, Apr. 8, 1991.
Foreign Counterpart Search Report and Written Opinion Application No. PCT/GB2005/004009 filed Jan. 11, 2006.

* cited by examiner

METHODS OF STIMULATING A SUBTERRANEAN FORMATION COMPRISING MULTIPLE PRODUCTION INTERVALS

BACKGROUND

The present invention relates to subterranean stimulation operations and, more particularly, to methods of stimulating a subterranean formation comprising multiple production intervals.

To produce hydrocarbons (e.g., oil, gas, etc) from a subterranean formation, well bores may be drilled that penetrate the hydrocarbon-containing portions of the subterranean formation. The portion of the subterranean formation from which hydrocarbons may be produced is commonly referred to as a "production interval." In some instances, a subterranean formation penetrated by the well bore may have multiple production intervals at various depths in the well bore.

Generally, after a well bore has been drilled to a desired depth completion operations may be performed. Completion operations may involve the insertion of casing into a well bore, and thereafter the casing, if desired, may be cemented into place. So that hydrocarbons may be produced from the subterranean formation, one or more perforations may be created that penetrate through the casing, through the cement, and into the production interval. At some point in the completion operation, a stimulation operation may be performed to enhance hydrocarbon production from the well bore. Stimulation operations may involve hydraulic fracturing, acidizing, fracture acidizing, or other suitable stimulation operations. Once the stimulation operation has been completed and after any intermediate steps, the well bore may be placed into production. Generally, the produced hydrocarbons flow from the production intervals, through the perforations that connect the production intervals with the well bore, into the well bore, and to the surface.

Stimulation operations such as these may be problematic in subterranean formations comprising multiple production intervals. In particular, problems may result in stimulation operations where the well bore penetrates multiple perforated and depleted intervals due to the variation of fracture gradients between these intervals. The most depleted intervals typically have the lowest fracture gradients among the multiple production intervals. When a stimulation operation is simultaneously conducted on all of the production intervals, the treatment fluid may preferentially enter the most depleted intervals. Therefore, the stimulation operation may not achieve desirable results in those production intervals having relatively higher fracture gradients. Packers and/or bridge plugs may be used to isolate the particular production interval before the stimulation operations, but this may be problematic due to the existence of open perforations in the well bore and the potential sticking of these mechanical isolation devices.

Another method conventionally used to combat problems encountered during the stimulation of a subterranean formation having multiple production intervals has been to perform a remedial cementing operation prior to the stimulation operation to plug the open perforations in the well bore, thereby hopefully preventing the undesired entry of the stimulation fluid into the most depleted intervals of the well bore. Once the pre-existing perforations are plugged with cement, a particular production interval may be perforated and then stimulated. While these remedial cementing operations may plug some of the pre-existing perforations and thus reduce the entry of the stimulation fluid into undesired portions of the formation, remedial cementing operations may not be completely effective in plugging all the pre-existing perforations in the well, requiring multiple remedial cementing operations to ensure complete plugging of all the pre-existing perforations. Further, remedial cementing operations may damage near well bore areas of the subterranean formation and/or require further remedial operations to remove undesired cement from the well bore before the well may be placed back into production.

SUMMARY

The present invention relates to subterranean stimulation operations and, more particularly, to methods of stimulating a subterranean formation comprising multiple production intervals.

In one embodiment, the present invention provides a method of stimulating a production interval adjacent a well bore having a casing disposed therein, the method comprising: introducing a carrier fluid comprising first particulates into the well bore; packing the first particulates into a plurality of perforations in the casing; perforating at least one remedial perforation in the casing adjacent to the production interval, subsequent to the packing the first particulates; and stimulating the production interval through the at least one remedial perforation.

In another embodiment, the present invention provides a method of stimulating a production interval adjacent a well bore having a casing disposed therein, the method comprising: introducing a carrier fluid comprising first particulates into the well bore; packing the first particulates into a plurality of perforations in the casing; providing a hydraulic jetting tool having at least one port, the hydrajetting tool attached to a work string; positioning the hydraulic jetting tool in the well bore adjacent the production interval; jetting a jetting fluid through the at least one nozzle in the hydraulic jetting tool against the casing in the well bore so as to create at least one remedial perforation in the casing; and stimulating the production interval through the at least one remedial perforation.

In yet another embodiment, the present invention provides a method of stimulating multiple production intervals adjacent a well bore having a casing disposed therein, the method comprising: introducing a carrier fluid comprising first particulates into the well bore; packing the first particulates into a plurality of perforations in the casing; perforating at least one remedial perforation in the casing adjacent to a production interval, subsequent to the packing the first particulates; introducing a stimulation fluid into the well bore and into the at least one remedial perforation so as to contact the production interval; and repeating the acts of perforating at least one remedial perforation and introducing the stimulation fluid for each of the remaining production intervals.

The features and advantages of the present invention will be readily apparent to those skilled in the art upon a reading of the description of the specific embodiments that follows.

DRAWINGS

A more complete understanding of the present disclosure and advantages thereof may be acquired by referring to the following description taken in conjunction with the accompanying drawings, wherein.

Figure 1:
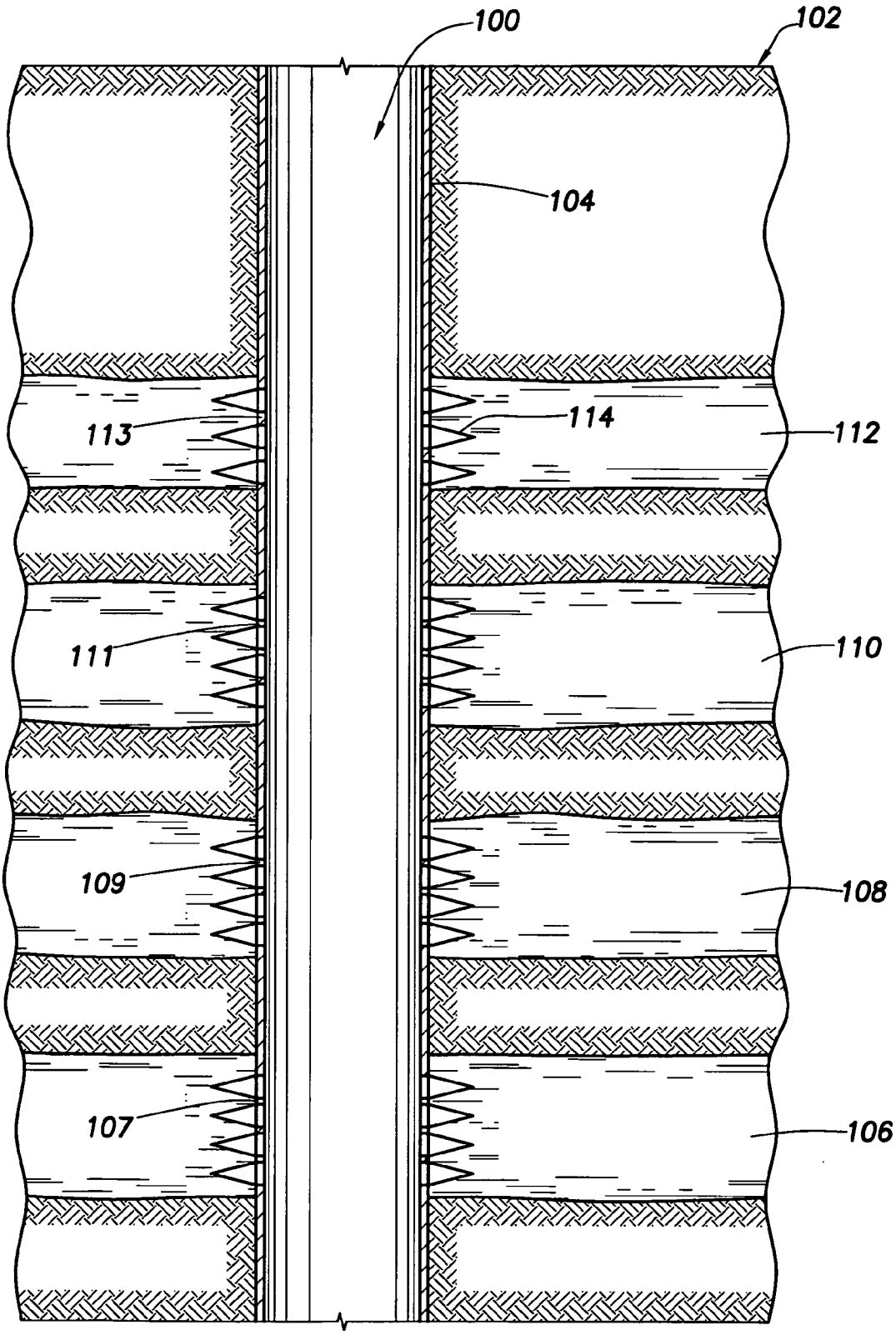
FIG. 1 illustrates a cross-sectional side view of a vertical well bore that penetrates multiple production intervals in accordance with one embodiment of the present invention.

While the present invention is susceptible to various modifications and alternative forms, specific exemplary embodiments thereof have been shown by way of example in the drawings and are herein described in detail. It should be understood, however, that the description herein of specific embodiments is not intended to limit or define the invention to the particular forms disclosed, but on the contrary, the intention is to cover all modifications, equivalents, and alternatives falling within the spirit and scope of the invention as defined by the appended claims.

DESCRIPTION

The present invention relates to subterranean stimulation operations and, more particularly, to methods of stimulating a subterranean formation comprising multiple production intervals. While the methods of the present invention are useful in a variety of applications, they may be particularly useful for stimulation operations in coal-bed-methane wells, high-permeability reservoirs suffering from near-well-bore compaction, or any well containing multiple perforated intervals that need stimulation. Among other things, the methods of the present invention allow for the closing of perforations in certain intervals of a well bore so that a desired interval or intervals of the subterranean formation may be stimulated.

Referring to FIG. 1, a cross-sectional side view of a well bore in accordance with an embodiment of the present invention is shown. The well bore is generally indicated at 100. While well bore 100 is depicted as a generally vertical well bore, the methods of the present invention may be performed in generally horizontal, inclined, or otherwise formed portions of well bores. In addition, well bore 100 may include multilaterals, wherein well bore 100 may be a primary well bore having one or more branch well bores extending therefrom, or well bore 100 may be a branch well bore extending laterally from a primary well bore. Well bore 100 penetrates subterranean formation 102 and has casing 104 disposed therein. Casing 104 may or may not be cemented in well bore 100 by a cement sheath (not shown). While FIG. 1 depicts well bore 100 as a cased well bore at least a portion of well bore 100 may be left openhole. Generally, subterranean formation 102 contains multiple production intervals, including lowermost or first production interval 106, second production interval 108, third production interval 110, and fourth production interval 112. The intervals of casing 104 adjacent to production intervals 106, 108, 110, 112 are perforated by plurality of perforations 114, wherein plurality of perforations 114 penetrate through casing 104, through the cement sheath (if present), and into production intervals 106, 108, 110, 112. The intervals of casing 104 adjacent to production intervals 106, 108, 110, 112 are first casing interval 107, second casing interval 109, third casing interval 111, and fourth casing interval 113, respectively.

Figure 2:
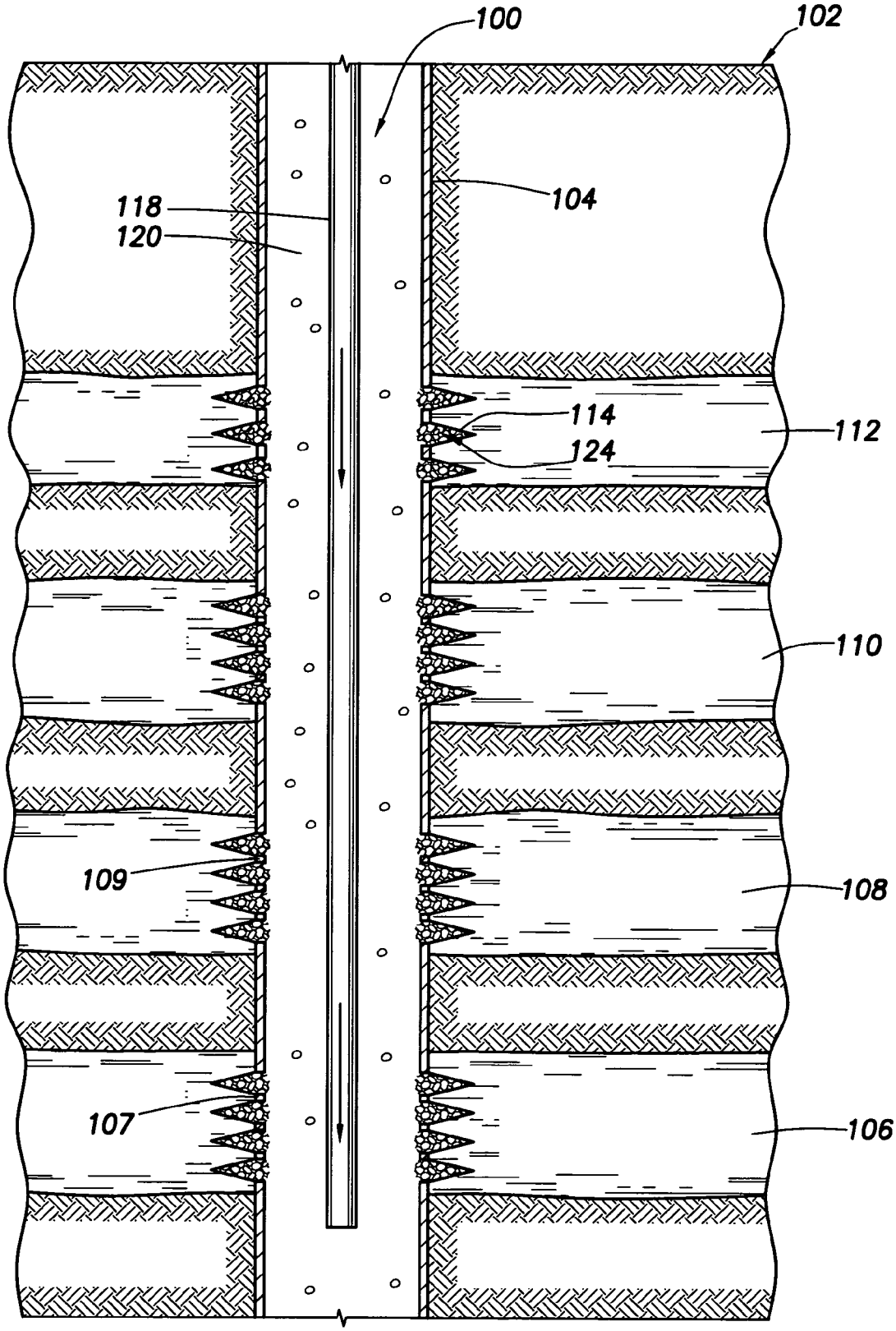
FIG. 2 illustrates a cross-sectional side view of the well bore shown in FIG. 1 having a conduit disposed therein in accordance with one embodiment of the present invention.

Referring now to FIG. 2, conduit 118 is shown disposed in well bore 100. Conduit 118 may be coiled tubing, jointed pipe, or any other suitable conduit for the delivery of fluids during subterranean operations. Annulus 120 is defined between casing 104 and conduit 118.

As shown in FIG. 2, in accordance with one embodiment of the methods of the present invention, a carrier fluid may be introduced into well bore 100 by pumping the carrier fluid down conduit 118. In another embodiment, carrier fluid may be introduced into well bore 100 by pumping the carrier fluid down annulus 120. The carrier fluid should contain first particulates. The carrier fluid and the first particulates will be discussed further below.

The first particulates in the carrier fluid should be allowed to pack into plurality of perforations 114, thereby forming particulate packs 124 in each of the plurality of perforations 114. Any suitable method may be used to introduce the carrier fluid into well bore 100 so that particulate packs 124 are formed. Generally, the carrier fluid may be introduced into well bore 100 so that downhole pressures are sufficient for the carrier fluid to squeeze into production intervals 106, 108, 110, 112, but the downhole pressures are below the respective fracture gradients until plurality of perforations 114 are effectively packed with particulates. Surface pumping pressures may be monitored to determine when particulate packs 124 have formed in each of the plurality of perforations 114. For example, when the surface pumping pressures of the carrier fluid increase above a pressure necessary for the downhole pressures to exceed the fracture gradients of production intervals 106, 108, 110, 112 without fracturing of such intervals, particulate packs 124 should have formed in each of the plurality of perforations 114. In certain embodiments, back pressure should be held on annulus 120, among other things so that the carrier fluid enters plurality of perforations 114 and is squeezed into the matrix of subterranean formation 102, so that carrier fluid is spread across plurality of perforations 114, and so that carrier fluid maintains sufficient velocity for proppant suspension without exceeding fracturing pressures. In one embodiment, back pressure is applied on annulus 120 by limiting the return of the carrier fluid up through annulus 120 by utilizing a choke mechanism at the surface (not shown). As the carrier fluid enters plurality of perforations 114 and is squeezed into the matrix of subterranean formation 102, the first particulates in the carrier fluid should bridge in plurality of perforations 114 and thus pack into plurality of perforations 114 forming particulate packs 124 therein. One of ordinary skill in the art will recognize other suitable methods for squeezing the carrier fluid into the matrix of subterranean formation 102.

Figure 3:
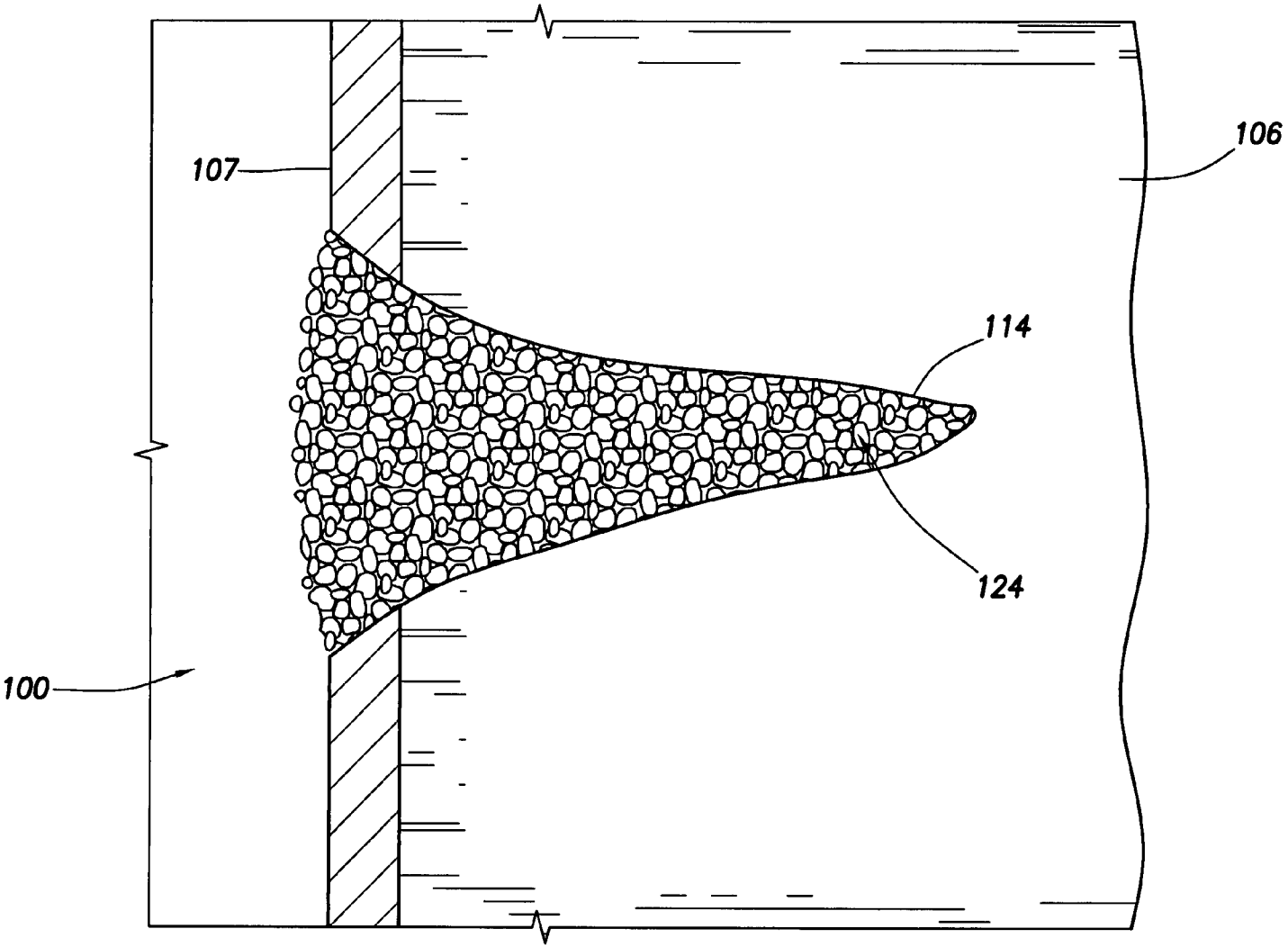
FIG. 3 illustrates a cross-sectional side view of a perforation after having a particulate pack placed therein in accordance with one embodiment of the present invention.

Referring now to FIG. 3, a cross-sectional side view of particulate pack 124 in perforation 114 is shown, in accordance with one embodiment of the methods of the present invention. Perforation 114 penetrates through first casing interval 107 and into first production interval 106. As discussed above, first particulates are packed into perforation 114, thereby forming particulate pack 124.

In certain embodiments, once particulate packs 124 have been formed in plurality of perforations 114, particulate packs 124 may be contacted with a second carrier fluid that contains second particulates. Generally, the second particulates are of a smaller size than the first particulates so that the second particulates may plug at least a portion of the interstitial spaces between the first particulates in particulate packs 124. In one certain embodiment, the second carrier fluid containing the second particulates may be introduced into well bore 100 as the pad fluid for a stimulation operation performed on first production interval 106. The second carrier fluid and second particulates will be discussed in more detail below. The second carrier fluid may be introduced into well bore 100 by any suitable manner, for example, by pumping the second carrier fluid down conduit 118. Generally, the second carrier fluid may be introduced into well bore 100 so that downhole pressures are sufficient for the second carrier fluid to squeeze into particulate packs 124 and into production intervals 106, 108, 110, 112, but the downhole pressures are below production intervals' 106, 108, 110, 112 respective fracture gradients. In certain embodiments, back pressure should be held on annulus 120 so that the second carrier fluid is squeezed into particulate packs 124 and thus into the matrix of subterranean formation 102, plugging at least portion of the interstitial spaces between the first particulates in particulate packs 124, thereby forming a filter cake at the surface of particulate packs 124. When a filter cake has formed at the surface of particulate packs 124, the leak off rate of the second carrier fluid into the matrix of subterranean formation 102 through particulate packs 124 should be reduced, as indicated by the rate of pressure fall off during shut-in immediately after pumping the second carrier fluid.

Figure 4:
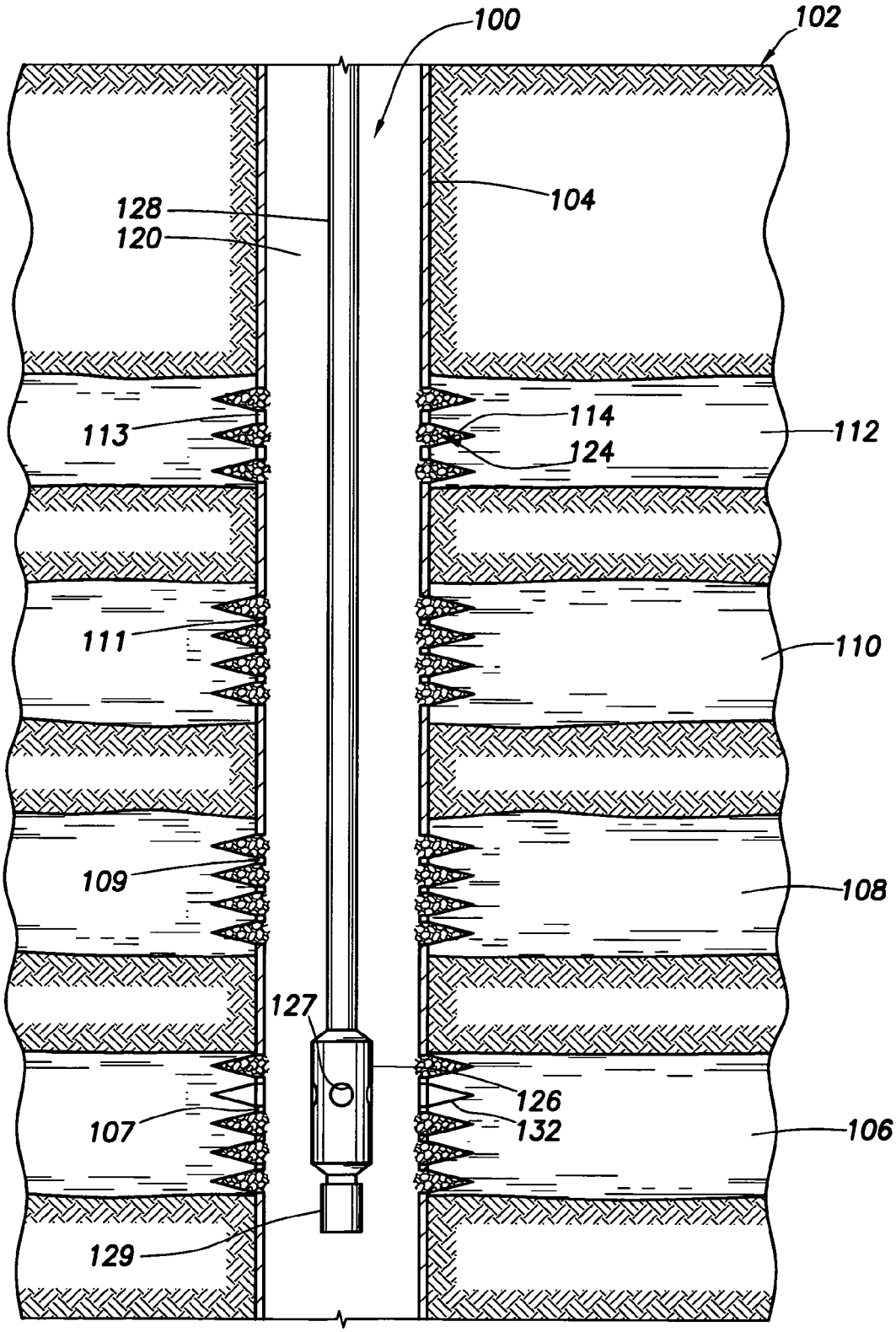
FIG. 4 illustrates a cross-sectional side view of the well bore shown in FIGS. 1–2 having a hydraulic jetting tool disposed therein after creation of remedial perforations in the casing.

Referring now to FIG. 4, once particulate packs 124 are formed by the introduction of the carrier fluid into well bore 100 and, if desired, second carrier fluid is introduced into well bore 100, the methods of the present invention may further comprise perforating at least one remedial perforation 132 in casing 104 adjacent to a production interval (e.g., production interval 106). These perforations are referred to as "remedial" because they are created after an initial completion process has been performed in the well. Further, the at least one remedial perforation 132 may be created in one or more previously perforated intervals of casing 104 (e.g., casing intervals 107, 109, 111, 113) and/or one or more previously unperforated intervals of casing 104. The at least one remedial perforation 132 may penetrate through casing 104 and into a portion of subterranean formation 102 adjacent thereto. For example, the at least one remedial perforation 132 may penetrate through first casing interval 107 and into first production interval 106.

As illustrated in FIG. 4, hydraulic jetting tool 126 is shown disposed in well bore 100. Hydraulic jetting tool 126 contains at least one port 127. Hydraulic jetting tool 126 may be any suitable assembly for use in subterranean operations through which a fluid may be jetted at high pressures, including those described in U.S. Pat. No. 5,765,642, the relevant disclosure of which is incorporated herein by reference. In one embodiment, hydraulic jetting tool 126 is attached to work string 128, in the form of piping or coiled tubing, which lowers hydraulic jetting tool 126 into well bore 100 and supplies it with jetting fluid. Optional valve subassembly 129 may be attached to the end of hydraulic jetting tool 126 to cause the flow of the fluid (referred to herein as "jetting fluid") to discharge through at least one port 127 in hydraulic jetting tool 126. Annulus 120 is defined between casing 104 and work string 128. In one embodiment, hydraulic jetting tool 126 is positioned in well bore 100 adjacent to casing 104 in a location (such as first casing interval 107) that is adjacent to a production interval (such as first production interval 106). Hydraulic jetting tool 126 then operates to form at least one remedial perforation 132 by jetting the jetting fluid through at least one port 127 and against first casing interval 107. At least one remedial perforation 132 may penetrate through the first casing interval 107 and into first production interval 106 adjacent thereto. The jetting fluid may contain a base fluid (e.g., water) and abrasives (e.g., sand). In one embodiment, sand is present in the jetting fluid in an amount of about 1 pound per gallon of the base fluid. While the above description describes the use of hydraulic jetting tool 126 to create at least one remedial perforation 132 in first casing interval 107, any suitable method may be used create at least one remedial perforation 132 in first casing interval 107. Suitable methods include all perforating methods known to those of ordinary skill in the art, but are not limited to, bullet perforating, jet perforating, and hydraulic jetting.

Figure 5:
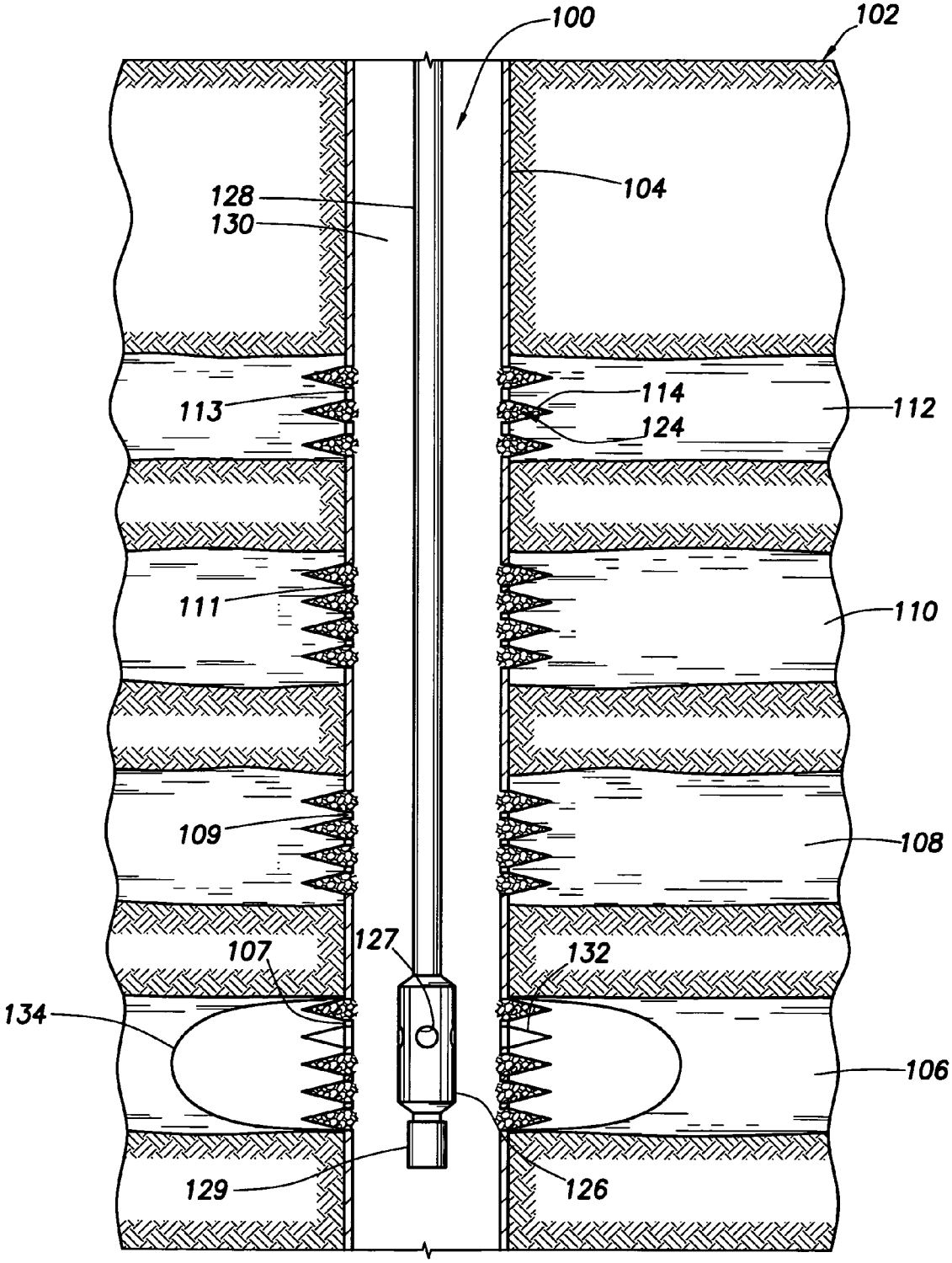
FIG. 5 illustrates a cross-sectional side view of the well bore shown in FIGS. 1, 2, and 4 after creation of fractures in an interval of the subterranean formation.

In accordance with the methods of the present invention, once at least one remedial perforation 132 has been created in casing 104 at the desired location (e.g., first casing interval 107 adjacent to first production interval 106), the subterranean formation 102 (e.g., first production interval 106) may be stimulated through the at least one remedial perforation 132. Referring now to FIG. 5, the stimulation of first production interval may be commenced using hydraulic jetting tool 126 shown disposed in well bore 100, in accordance with one embodiment of the present invention. In these embodiments, once at least one remedial perforation 132 has been created in first casing interval 107 using hydraulic jetting tool 126, the stimulation fluid may be pumped into well bore 100, down annulus 130, and into at least one remedial perforation 132 at a pressure sufficient to create or enhance at least one fracture 134 in subterranean formation 100, e.g., first production interval 106, along at least one remedial perforation 132. While FIG. 5 depicts at least one fracture 134 as a longitudinal fracture that is approximately longitudinal or parallel to the axis of well bore 100, those of ordinary skill in the art will recognize that the direction and orientation of the at least one fracture 134 is dependent on a number of factors, including rock mechanical stress, reservoir pressure, and perforation orientation. In certain embodiments, a jetting fluid may be pumped down through work string 128 and jetted through at least one port 127, through the at least one remedial perforation 132, and against first production interval 106, wherein hydraulic jetting tool 126 is positioned adjacent to at least one remedial perforation 132. In certain embodiments, the step of jetting the jetting fluid against first production interval 106 may occur simultaneously with the pumping of the stimulation fluid into well bore 100, down annulus 130, and into at least one remedial perforation 132, so as to create or enhance at least one fracture 134 in first production interval 106 along at least one remedial perforation 132. Proppant may be included in the stimulation fluid and/or the jetting fluid as desired so as to support at least one fracture 134 and prevent it from fully closing after hydraulic pressure is released. Suitable methods of fracturing a subterranean formation utilizing a hydraulic jetting tool are described in U.S. Pat. No. 5,765,642, the relevant disclosure of which is incorporated herein by reference.

While the above description describes the use of hydraulic jetting tool 126 to create or enhance at least one fracture 134, any suitable method of stimulation may be used to stimulate the desired interval of subterranean formation 102, including, but are not limited to, hydraulic fracturing and fracture acidizing operations. In some embodiments, the stimulation of first production interval 106 comprises introducing a stimulation fluid into well bore 100 and into at least one remedial perforation 132 so as to contact first production interval 106. In another embodiment, stimulation fluid is introduced into well bore 100 so as to contact first production interval 106 at a pressure sufficient to create at least one fracture in first production interval 106.

Figure 6:
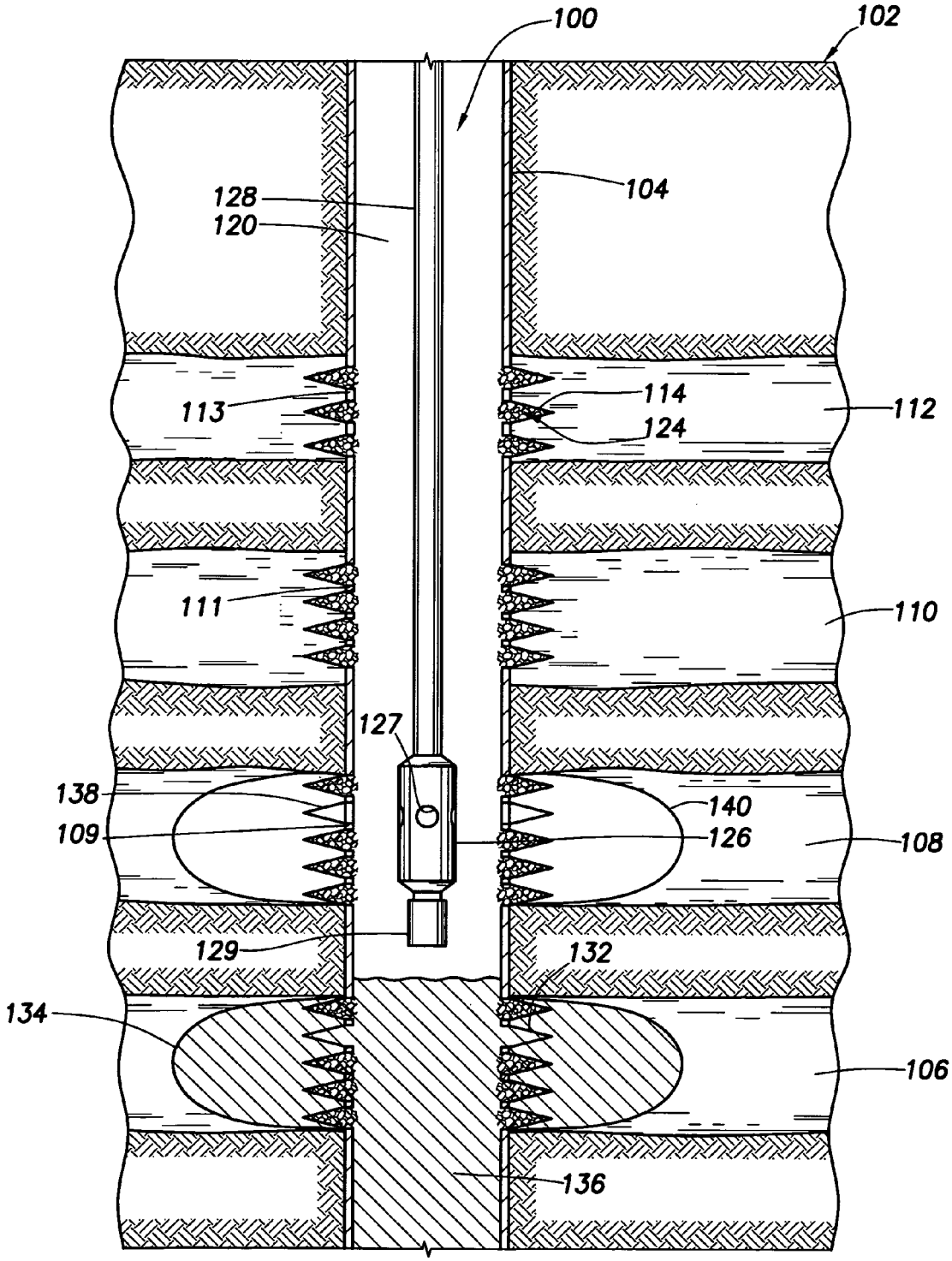
FIG. 6 illustrates a cross-sectional side view of the well bore shown in FIGS. 1, 2, 4, and 5 having a hydraulic jetting tool in position for perforating a second interval of the well bore.

In accordance with one embodiment of the present invention, once the desired interval of subterranean formation 102, such as first production interval 106, has been stimulated, sufficient sand may be introduced into well bore 100 via the stimulation fluid (e.g., annulus fluid, jetting fluid, or both) to form sand plug 136 in casing 104, as depicted in FIG. 6. Once the hydraulic pressure is released, the sand should settle to form sand plug 136 adjacent to first casing interval 107 extending above at least one remedial perforation 132. In some embodiments, sand plug 136 may be adjacent to first casing interval 107 extending from an optional mechanical plug to above at least one remedial perforation 132. Sand plug 136 acts to isolate the stimulated section of subterranean formation 102, e.g., first production interval 106. One of ordinary skill in the art will recognize other suitable methods of isolating the stimulated section of subterranean formation 102 that may be suitable for use with the methods of the present invention.

Having perforated and stimulated a desired interval (such as first casing interval 107 and first production interval 106), in the manner described above, an operator may elect to repeat the above acts of perforating and stimulating for each of the remaining production intervals (such as production intervals 108, 110, 112). Referring now to FIG. 6, for example, the operator may next elect to perforate at least one remedial perforation 138 in casing 104 adjacent to second production interval 108 and then stimulate second production interval through the at least one remedial perforation 138. In some embodiments, at least one remedial perforation 138 may be created in second casing interval 109 and a stimulation fluid may be introduced into well bore 100 and into the at least one remedial perforation 138 created therein so as to contact the second production interval 108 of subterranean formation 106. In some embodiments, as illustrated in FIG. 6, hydraulic jetting tool 126 may be positioned adjacent to second casing interval 109 and used to create at least one remedial perforation 138 in second casing interval 109. Thereafter, in the manner described above, at least one fracture 140 may be created or enhanced along at least one remedial perforation 138. In certain embodiments of the present invention wherein an operator uses the methods of the present invention to stimulate multiple production intervals of subterranean formation 102 (such as production intervals 106, 108, 110, 112), the operator may elect to sequentially stimulate the production intervals intersected by well bore 100, beginning with the deepest production interval (e.g., first production interval 106), and sequentially stimulating the shallower desired intervals, such as production intervals 108, 110, 112.

In certain embodiments, clean-out fluids optionally may be introduced into well bore 100. Generally, clean-out fluids, where used, may be introduced into well bore 100 at any suitable time as desired by one of ordinary skill in the art, for example, to e.g., to clean out debris, cuttings, pipe dope, and other materials from well bore 100 and inside equipment, such as conduit 118 or hydraulic jetting tool 126 that may be disposed in well bore 100. For example, a clean out fluid may be used after completion of the stimulation operations so as to remove the sand plugs, such as sand plug 136 that may be in well bore 100. In some embodiments, the clean out fluid may be used after the carrier fluid has been introduced into well bore 100 so as to remove any of the first particulates that are loose in well bore 100. Generally, the clean-out fluids should not be circulated into well bore 100 at sufficient rates and pressures to impact the integrity of particulate packs 124. Generally, the cleaning fluid may be any conventional fluid used to prepare a formation for stimulation, such as water-based or oil-based fluids. In some embodiments, these cleaning fluids may be energized fluids that contain a gas, such as nitrogen or air.

While the above-described steps describe the use of conduit 118 to introduce the carrier fluid and the second carrier fluid into well bore 100, any suitable methodology may be used to introduce such fluids into well bore 100. In some embodiments, work string 128 with hydraulic jetting tool 126 attached thereto and optional valve subassembly 129 attached to the end of hydraulic jetting tool 126 may be used in the above-described step of introducing the carrier fluid containing first particulates into well bore 100. This may save at least one trip out of the well bore, between the steps of packing the first particulates into plurality of perforations 114 and perforating at least one remedial perforation 132 because the same downhole equipment may be used for both steps. For example, hydraulic jetting tool 126 may have a longitudinal fluid flow passageway extending therethrough and optional valve subassembly 129 may have a longitudinal fluid flow passageway extending therethough. When optional valve subassembly 129 is not activated, fluid flows down through work string 128, into hydraulic jetting tool 126, and out through optional valve subassembly 129. Accordingly, in some embodiments, the carrier fluid may be introduced into well bore 100 by pumping the carrier fluid down work string 128, into hydraulic jetting tool 126, and out into well bore 100 through optional valve subassembly 129. Similarly, second carrier fluid also may be introduced into well bore 100. When desired to perform the above-described remedial perforation and/or stimulation steps, optional valve subassembly 129 should be activated thereby causing the flow of fluid to discharge through at least one port 127.

The carrier fluid that may be used in accordance with the present invention, may include any suitable fluids that may be used to transport particulates in subterranean operations. Suitable fluids include ungelled aqueous fluids, aqueous gels, hydrocarbon-based gels, foams, emulsions, viscoelastic surfactant gels, and any other suitable fluid. Where the carrier fluid is an ungelled aqueous fluid, it should be introduced into the well bore at a sufficient rate to transport the first particulates. Suitable emulsions can be comprised of two immiscible liquids such as an aqueous liquid or gelled liquid and a hydrocarbon. Foams can be created by the addition of a gas, such as carbon dioxide or nitrogen. Suitable aqueous gels are generally comprised of water and one or more gelling agents. In exemplary embodiments, the carrier fluid is an aqueous gel comprised of water, a gelling agent for gelling the aqueous component and increasing its viscosity, and, optionally, a crosslinking agent for crosslinking the gel and further increasing the viscosity of the fluid. The increased viscosity of the gelled, or gelled and crosslinked, aqueous gels, inter alia, reduces fluid loss and enhances the suspension properties thereof. An example of a suitable crosslinked aqueous gel is a borate fluid system utilized in the "Delta Frac®" fracturing service, commercially available from Halliburton Energy Services, Duncan Okla. Another example of a suitable crosslinked aqueous gel is a borate fluid system utilized in the "Seaques®" fracturing service, commercially available from Halliburton Energy Services, Duncan, Okla. The water used to form the aqueous gel may be fresh water, saltwater, brine, or any other aqueous liquid that does not adversely react with the other components. The density of the water can be increased to provide additional particle transport and suspension in the present invention.

As mentioned above, the carrier fluid contains first particulates. First particulates used in accordance with the present invention are generally particulate materials of a size such that the first particulates bridge plurality of perforations 114 in casing 104 and form proppant packs 124 therein. The first particulates used may have an average particle size in the range of from about 10 mesh to about 100 mesh. A wide variety of particulate materials may be used as the first particulates in accordance with the present invention including sand; bauxite; ceramic materials; glass materials; polymer materials; Teflon® materials; nut shell pieces; seed shell pieces; cured resinous particulates comprising nut shell pieces; cured resinous particulates comprising seed shell pieces; fruit pit pieces; cured resinous particulates comprising fruit pit pieces; wood; composite particulates; and combinations thereof. Suitable composite particulates may comprise a binder and a filler material wherein suitable filler materials include silica, alumina, fumed carbon, carbon black, graphite, mica, titanium dioxide, meta-silicate, calcium silicate, kaolin, talc, zirconia, boron, fly ash, hollow glass microspheres, solid glass, and combinations thereof. Generally, the first particulates may be present in the carrier fluid in an amount in an amount sufficient to form the desired proppant packs 124 in plurality of perforations 114. In some embodiments, the first particulates, may be present in the carrier fluid in an amount in the range of from about 2 pounds to about 12 pounds per gallon of the carrier fluid not inclusive of the first particulates.

Generally, the first particulates do not degrade in the presence of hydrocarbon fluids and other fluids present in portion of the subterranean formation; this allows the first particulates to maintain their integrity in the presence of produced hydrocarbon products, formation water, and other compositions normally produced from subterranean formations. However, in some embodiments of the present invention, the first particulates may comprise degradable materials. Degradable materials may be included in the first particulates, for example, so that proppant packs 124 may degrade over time. Such degradable materials are capable of undergoing an irreversible degradation downhole. The term "irreversible" as used herein means that the degradable material, once degraded downhole, should not recrystallize or reconsolidate, e.g., the degradable material should degrade in situ but should not recrystallize or reconsolidate in situ.

The degradable materials may degrade by any suitable mechanism. Suitable degradable materials may be water-soluble, gas-soluble, oil-soluble, biodegradable, temperature degradable, solvent-degradable, acid-soluble, oxidizer-degradable, or a combination thereof. Suitable degradable materials include a variety of degradable materials suitable for use in subterranean operations and may comprise dehydrated materials, waxes, boric acid flakes, degradable polymers, calcium carbonate, paraffins, crosslinked polymer gels, combinations thereof, and the like. One example of a suitable degradable crosslinked polymer gel is "Max Seal™" fluid loss control additive, commercially available from Halliburton Energy Services, Duncan, Okla. An example of a suitable degradable polymeric material is "BioBalls™" perforation ball sealers, commercially available from Santrol Corporation, Fresno, Tex.

In some embodiments, the degradable material comprises an oil-soluble material. Where such oil-soluble materials are used, the oil-soluble materials may be degraded by the produced fluids, thus degrading particulate packs 124 so as to unblock plurality of perforations 114. Suitable oil-soluble materials include either natural or synthetic polymers, such as, for example, polyacrylics, polyamides, and polyolefins (such as polyethylene, polypropylene, polyisobutylene, and polystyrene).

Suitable examples of degradable polymers that may be used in accordance with the present invention include, but are not limited to, homopolymers, random, block, graft, and star- and hyper-branched polymers. Specific examples of suitable polymers include polysaccharides (such as dextran or cellulose); chitin; chitosan; proteins; aliphatic polyesters; poly(lactide); poly(glycolide); poly(ε-caprolactone); poly (hydroxybutyrate); poly(anhydrides); aliphatic polycarbonates; poly(ortho esters); poly(amino acids); poly(ethylene oxide); polyphosphazenes; copolymers thereof; and combinations thereof. Polyanhydrides are another type of particularly suitable degradable polymer useful in the present invention. Examples of suitable polyanhydrides include poly(adipic anhydride), poly(suberic anhydride), poly(sebacic anhydride), poly(dodecanedioic anhydride). Other suitable examples include but are not limited to poly(maleic anhydride) and poly(benzoic anhydride). One skilled in the art will recognize that plasticizers may be included in forming suitable polymeric degradable materials of the present invention. The plasticizers may be present in an amount sufficient to provide the desired characteristics, for example, more effective compatibilization of the melt blend components, improved processing characteristics during the blending and processing steps, and control and regulation of the sensitivity and degradation of the polymer by moisture.

Suitable dehydrated compounds are those materials that will degrade over time when rehydrated. For example, a particulate solid dehydrated salt or a particulate solid anhydrous borate material that degrades over time may be suitable. Specific examples of particulate solid anhydrous borate materials that may be used include but are not limited to anhydrous sodium tetraborate (also known as anhydrous borax), and anhydrous boric acid. These anhydrous borate materials are only slightly soluble in water. However, with time and heat in a subterranean environment, the anhydrous borate materials react with the surrounding aqueous fluid and are hydrated. The resulting hydrated borate materials are substantially soluble in water as compared to anhydrous borate materials and as a result degrade in the aqueous fluid.

Blends of certain degradable materials and other compounds may also be suitable. One example of a suitable blend of materials is a mixture of poly(lactic acid) and sodium borate where the mixing of an acid and base could result in a neutral solution where this is desirable. Another example would include a blend of poly(lactic acid) and boric oxide. In choosing the appropriate degradable material or materials, one should consider the degradation products that will result. The degradation products should not adversely affect subterranean operations or components. The choice of degradable material also can depend, at least in part, on the conditions of the well, e.g., well bore temperature. For instance, lactides have been found to be suitable for lower temperature wells, including those within the range of 60° F. to 150° F., and polylactides have been found to be suitable for well bore temperatures above this range. Poly(lactic acid) and dehydrated salts may be suitable for higher temperature wells. Also, in some embodiments a preferable result is achieved if the degradable material degrades slowly over time as opposed to instantaneously. In some embodiments, it may be desirable when the degradable material does not substantially degrade until after the degradable material has been substantially placed in a desired location within a subterranean formation.

In certain embodiments of the present invention, the first particulates are coated with an adhesive substance. As used herein, the term "adhesive substance" refers to a material that is capable of being coated onto a particulate and that exhibits a sticky or tacky character such that the proppant particulates that have adhesive thereon have a tendency to create clusters or aggregates. As used herein, the term "tacky," in all of its forms, generally refers to a substance having a nature such that it is (or may be activated to become) somewhat sticky to the touch. Generally, the first particulates may be coated with an adhesive substance so that the first particulates once placed within plurality of perforations 114 to form particulate packs 124 may consolidate into the first particulates into a hardened mass. Adhesive substances suitable for use in the present invention include non-aqueous tackifying agents; aqueous tackifying agents; silyl-modified polyamides; and curable resin compositions that are capable of curing to form hardened substances.

Tackifying agents suitable for use in the consolidation fluids of the present invention comprise any compound that, when in liquid form or in a solvent solution, will form a non-hardening coating upon a particulate. A particularly preferred group of tackifying agents comprise polyamides that are liquids or in solution at the temperature of the subterranean formation such that they are, by themselves, non-hardening when introduced into the subterranean formation. A particularly preferred product is a condensation reaction product comprised of commercially available polyacids and a polyamine. Such commercial products include compounds such as mixtures of $C_{36}$ dibasic acids containing some trimer and higher oligomers and also small amounts of monomer acids that are reacted with polyamines. Other polyacids include trimer acids, synthetic acids produced from fatty acids, maleic anhydride, acrylic acid, and the like. Such acid compounds are commercially available from companies such as Witco Corporation, Union Camp, Chemtall, and Emery Industries. The reaction products are available from, for example, Champion Technologies, Inc. and Witco Corporation. Additional compounds which may be used as tackifying compounds include liquids and solutions of, for example, polyesters, polycarbonates and polycarbamates, natural resins such as shellac and the like. Other suitable tackifying agents are described in U.S. Pat. Nos. 5,853,048 and 5,833,000, the relevant disclosures of which are herein incorporated by reference.

Tackifying agents suitable for use in the present invention may be either used such that they form a non-hardening coating or they may be combined with a multifunctional material capable of reacting with the tackifying compound to form a hardened coating. A "hardened coating" as used herein means that the reaction of the tackifying compound with the multifunctional material will result in a substantially non-flowable reaction product that exhibits a higher compressive strength in a consolidated agglomerate than the tackifying compound alone with the particulates. In this instance, the tackifying agent may function similarly to a hardenable resin. Multifunctional materials suitable for use in the present invention include, but are not limited to, aldehydes such as formaldehyde, dialdehydes such as glutaraldehyde, hemiacetals or aldehyde releasing compounds, diacid halides, dihalides such as dichlorides and dibromides, polyacid anhydrides such as citric acid, epoxides, furfuraldehyde, glutaraldehyde or aldehyde condensates and the like, and combinations thereof. In some embodiments of the present invention, the multifunctional material may be mixed with the tackifying compound in an amount of from about 0.01 to about 50 percent by weight of the tackifying compound to effect formation of the reaction product. In some preferable embodiments, the compound is present in an amount of from about 0.5 to about 1 percent by weight of the tackifying compound. Suitable multifunctional materials are described in U.S. Pat. No. 5,839,510, the relevant disclosure of which is herein incorporated by reference. Other suitable tackifying agents are described in U.S. Pat. No. 5,853,048.

Solvents suitable for use with the tackifying agents of the present invention include any solvent that is compatible with the tackifying agent and achieves the desired viscosity effect. The solvents that can be used in the present invention preferably include those having high flash points (most preferably above about 125° F.). Examples of solvents suitable for use in the present invention include, but are not limited to, butylglycidyl ether, dipropylene glycol methyl ether, butyl bottom alcohol, dipropylene glycol dimethyl ether, diethyleneglycol methyl ether, ethyleneglycol butyl ether, methanol, butyl alcohol, isopropyl alcohol, diethyleneglycol butyl ether, propylene carbonate, d'limonene, 2-butoxy ethanol, butyl acetate, furfuryl acetate, butyl lactate, dimethyl sulfoxide, dimethyl formamide, fatty acid methyl esters, and combinations thereof. It is within the ability of one skilled in the art, with the benefit of this disclosure, to determine whether a solvent is needed to achieve a viscosity suitable to the subterranean conditions and, if so, how much.

Suitable aqueous tackifier agents are capable of forming at least a partial coating upon the surface of the first particulates. Generally, suitable aqueous tackifier agents are not significantly tacky when placed onto a particulate, but are capable of being "activated" (that is destabilized, coalesced and/or reacted) to transform the compound into a sticky, tackifying compound at a desirable time. Such activation may occur before, during, or after the aqueous tackifier compound is placed in the subterranean formation. In some embodiments, a pretreatment may be first contacted with the surface of a particulate to prepare it to be coated with an aqueous tackifier compound. Suitable aqueous tackifying agents are generally charged polymers that comprise compounds that, when in an aqueous solvent or solution, will form a non-hardening coating (by itself or with an activator) and, when placed on a particulate, will increase the continuous critical resuspension velocity of the particulate when contacted by a stream of water.

Examples of aqueous tackifier agents suitable for use in the present invention include, but are not limited to, acrylic acid polymers, acrylic acid ester polymers, acrylic acid derivative polymers, acrylic acid homopolymers, acrylic acid ester homopolymers (such as poly(methyl acrylate), poly(butyl acrylate), and poly(2-ethylhexyl acrylate)), acrylic acid ester co-polymers, methacrylic acid derivative polymers, methacrylic acid homopolymers, methacrylic acid ester homopolymers (such as poly(methyl methacrylate), poly(butyl methacrylate), and poly(2-ethylhexyl methacrylate)), acrylamido-methyl-propane sulfonate polymers, acrylamido-methyl-propane sulfonate derivative polymers, a thereof. Methods of determining suitable aqueous tackifier agents and additional disclosure on aqueous tackifier agents can be found in U.S. patent application Ser. No. 10/864,061 and filed Jun. 9, 2004 and U.S. patent application Ser. No. 10/864,618 and filed Jun. 9, 2004, the relevant disclosures of which are hereby incorporated by reference.

Silyl-modified polyamide compounds suitable for use as an adhesive substance in the methods of the present invention may be described as substantially self-hardening compositions that are capable of at least partially adhering to particulates in the unhardened state, and that are further capable of self-hardening themselves to a substantially non-tacky state to which individual particulates such as formation fines will not adhere. Such silyl-modified polyamides may be based, for example, on the reaction product of a silating compound with a polyamide or a mixture of polyamides. The polyamide or mixture of polyamides may be one or more polyamide intermediate compounds obtained, for example, from the reaction of a polyacid (e.g., diacid or higher) with a polyamine (e.g., diamine or higher) to form a polyamide polymer with the elimination of water. Other suitable silyl-modified polyamides and methods of making such compounds are described in U.S. Pat. No. 6,439,309, the relevant disclosure of which is herein incorporated by reference.

Curable resin compositions suitable for use in the consolidation fluids of the present invention generally comprise any suitable resin that is capable of forming a hardened, consolidated mass. Many such resins are commonly used in subterranean consolidation operations, and some suitable resins include two component epoxy based resins, novolak resins, polyepoxide resins, phenol-aldehyde resins, urea-aldehyde resins, urethane resins, phenolic resins, furan resins, furan/furfuryl alcohol resins, phenolic/latex resins, phenol formaldehyde resins, polyester resins and hybrids and copolymers thereof, polyurethane resins and hybrids and copolymers thereof, acrylate resins, and mixtures thereof. Some suitable resins, such as epoxy resins, may be cured with an internal catalyst or activator so that when pumped down hole, they may be cured using only time and temperature. Other suitable resins, such as furan resins generally require a time-delayed catalyst or an external catalyst to help activate the polymerization of the resins if the cure temperature is low (i.e., less than 250° F.), but will cure under the effect of time and temperature if the formation temperature is above about 250° F., preferably above about 300° F. It is within the ability of one skilled in the art, with the benefit of this disclosure, to select a suitable resin for use in embodiments of the present invention and to determine whether a catalyst is required to trigger curing.

Further, the curable resin composition further may contain a solvent. Any solvent that is compatible with the resin and achieves the desired viscosity effect is suitable for use in the present invention. Preferred solvents include those listed above in connection with tackifying compounds. It is within the ability of one skilled in the art, with the benefit of this disclosure, to determine whether and how much solvent is needed to achieve a suitable viscosity.

The second carrier fluid that may be used in accordance with the present invention, may include any suitable fluids that may be used to transport particulates in subterranean operations. Suitable fluids include ungelled aqueous fluids, aqueous gels, hydrocarbon-based gels, foams, emulsions, viscoelastic surfactant gels, and any other suitable fluid. Where the second carrier fluid is an ungelled aqueous fluid, it should be introduced into the well bore at a sufficient rate to transport the first particulates. Suitable emulsions can be comprised of two immiscible liquids such as an aqueous liquid or gelled liquid and a hydrocarbon. Foams can be created by the addition of a gas, such as carbon dioxide or nitrogen. Suitable aqueous gels are generally comprised of water and one or more gelling agents. In exemplary embodiments, the second carrier fluid is an aqueous gel comprised of water, a gelling agent for gelling the aqueous component and increasing its viscosity, and, optionally, a crosslinking agent for crosslinking the gel and further increasing the viscosity of the fluid. The increased viscosity of the gelled, or gelled and crosslinked, aqueous gels, inter alia, reduces fluid loss and enhances the suspension properties thereof. An example of a suitable crosslinked aqueous gel is a borate fluid system utilized in the "Delta Frac®" fracturing service, commercially available from Halliburton Energy Services, Duncan Okla. Another example of a suitable crosslinked aqueous gel is a borate fluid system utilized in the "Seaquest®" fracturing service, commercially available from Halliburton Energy Services, Duncan, Okla. The water used to form the aqueous gel may be fresh water, saltwater, brine, or any other aqueous liquid that does not adversely react with the other components. The density of the water can be increased to provide additional particle transport and suspension in the present invention.

As mentioned above, the second carrier fluid contains second particulates. The second particulates used in accordance with the present invention are generally particulate materials having an average particle size small than the average particle size of the first particulates so that the second particulates may plug at least a portion of the interstitial spaces between the first particulates in particulate packs 124. In certain embodiments, the second particulates used may have an average particle size of less than about 100 mesh. Examples of suitable particulate materials that may be used as the second particulates include, but are not limited to, silica flour, sand; bauxite; ceramic materials; glass materials; polymer materials; Teflon® materials; nut shell pieces; seed shell pieces; cured resinous particulates comprising nut shell pieces; cured resinous particulates comprising seed shell pieces; fruit pit pieces; cured resinous particulates comprising fruit pit pieces; wood; composite particulates; and combinations thereof. Suitable composite particulates may comprise a binder and a filler material wherein suitable filler materials include silica, alumina, fumed carbon, carbon black, graphite, mica, titanium dioxide, meta-silicate, calcium silicate, kaolin, talc, zirconia, boron, fly ash, hollow glass microspheres, solid glass, and combinations thereof. Generally, the second particulates should be included in the second carrier fluid in an amount sufficient to form the desired filter cake on the surface of proppant packs 124. In certain embodiments, the second particulates may be present in the second carrier fluid in an amount in the range of from about 30 pounds to about 100 pounds per 1,000 gallons of the second carrier fluid not inclusive of the second particulates. In certain embodiments, the second particulates may comprise degradable particulates of the type described above.

The stimulation and jetting fluids that may be used in accordance with the present invention, may include any suitable fluids that may be used in subterranean stimulation operations. In some embodiments, the stimulation fluid may have substantially the same composition as the jetting fluid. Suitable fluids include ungelled aqueous fluids, aqueous gels, hydrocarbon-based gels, foams, emulsions, viscoelastic surfactant gels, acidizing treatment fluids (e.g., acid blends) and any other suitable fluid. In some embodiments, the stimulation fluid and/or jetting fluid may contain an acid. Where the stimulation or jetting fluid is an ungelled aqueous fluid, it should be introduced into the well bore at a sufficient rate to transport proppant (where present). Suitable emulsions can be comprised of two immiscible liquids such as an aqueous gelled liquid and a liquefied, normally gaseous, fluid, such as carbon dioxide or nitrogen. Foams can be created by the addition of a gas, such as carbon dioxide or nitrogen. Suitable aqueous gels are generally comprised of water and one or more gelling agents. In exemplary embodiments, the jetting fluid and/or stimulation fluid is an aqueous gel comprised of water, a gelling agent for gelling the aqueous component and increasing its viscosity, and, optionally, a crosslinking agent for crosslinking the gel and further increasing the viscosity of the fluid. The increased viscosity of the gelled, or gelled and crosslinked, aqueous gels, inter alia, reduces fluid loss and enhances the suspension properties thereof. The water used to form the aqueous gel may be fresh water, saltwater, brine, or any other aqueous liquid that does not adversely react with the other components. The density of the water can be increased to provide additional particle transport and suspension in the present invention. One of ordinary skill in the art, with the benefit of this disclosure, will be able to determine the appropriate stimulation and/or jetting fluid for a particulate application.

Optionally, proppant may be included in the stimulation fluid, the jetting fluid, or both. Among other things, proppant may be included to prevent fractures formed in the subterranean formation from fully closing once the hydraulic pressure is released. A variety of suitable proppant may be used, for example, sand; bauxite; ceramic materials; glass materials; polymer materials; Teflon® materials; nut shell pieces; seed shell pieces; cured resinous particulates comprising nut shell pieces; cured resinous particulates comprising seed shell pieces; fruit pit pieces; cured resinous particulates comprising fruit pit pieces; wood; composite particulates; and combinations thereof. Suitable composite particulates may comprise a binder and a filler material wherein suitable filler materials include silica, alumina, fumed carbon, carbon black, graphite, mica, titanium dioxide, meta-silicate, calcium silicate, kaolin, talc, zirconia, boron, fly ash, hollow glass microspheres, solid glass, and combinations thereof. One of ordinary skill in the art, with the benefit of this disclosure, should know the appropriate amount and type of proppant to include in the jetting fluid and/or stimulation fluid for a particular application.

In one embodiment, the present invention provides a method of stimulating a production interval adjacent a well bore having a casing disposed therein, the method comprising: introducing a carrier fluid comprising first particulates into the well bore; packing the first particulates into a plurality of perforations in the casing; perforating at least one remedial perforation in the casing adjacent to the production interval, subsequent to the packing the first particulates; and stimulating the production interval through the at least one remedial perforation.

In another embodiment, the present invention provides a method of stimulating a production interval adjacent a well bore having a casing disposed therein, the method comprising: introducing a carrier fluid comprising first particulates into the well bore; packing the first particulates into a plurality of perforations in the casing; providing a hydraulic jetting tool having at least one port, the hydrajetting tool attached to a work string; positioning the hydraulic jetting tool in the well bore adjacent the production interval; jetting a jetting fluid through the at least one nozzle in the hydraulic jetting tool against the casing in the well bore so as to create at least one remedial perforation in the casing; and stimulating the production interval through the at least one remedial perforation.

In yet another embodiment, the present invention provides a method of stimulating multiple production intervals adjacent a well bore having a casing disposed therein, the method comprising: introducing a carrier fluid comprising first particulates into the well bore; packing the first particulates into a plurality of perforations in the casing; perforating at least one remedial perforation in the casing adjacent to a production interval, subsequent to the packing the first particulates; introducing a stimulation fluid into the well bore and into the at least one remedial perforation so as to contact the production interval; and repeating the acts of perforating at least one remedial perforation and introducing the stimulation fluid for each of the remaining production intervals.

Therefore, the present invention is well adapted to carry out the objects and attain the ends and advantages mentioned as well as those which are inherent therein. While numerous changes may be made by those skilled in the art, such changes are encompassed within the spirit of this invention as defined by the appended claims.

What is claimed is:

1. A method of stimulating a production interval adjacent a well bore having a casing disposed therein, the method comprising:

introducing a carrier fluid comprising first particulates into the well bore;

packing the first particulates into a plurality of perforations in the casing;

perforating at least one remedial perforation in the casing adjacent to a production interval, subsequent to the packing the first particulates; and stimulating the production interval through the at least one remedial perforation.

2. The method of claim 1 wherein the well bore is a primary well bore or a branch well bore extending from a primary well bore.

3. The method of claim 1 wherein the carrier fluid is an ungelled aqueous fluid, an aqueous gel, a hydrocarbon-based gel, a foam, a viscoelastic surfactant gel, or combinations thereof.

4. The method of claim 1 wherein the carrier fluid comprises an aqueous component and a gelling agent.

5. The method of claim 4 wherein the gelling agent is crosslinked using a crosslinking agent.

6. The method of claim 1 wherein the first particulates have an average particle size of from about 10 mesh to about 100 mesh.

7. The method of claim 1 wherein the first particulates comprise at least one material selected from the group consisting of sand, bauxite, ceramic materials, glass materials, polymer materials, fluoropolymer materials, nut shell pieces, seed shell pieces, cured resinous particulates comprising nut shell pieces, cured resinous particulates comprising seed shell pieces, fruit pit pieces, cured resinous particulates comprising fruit pit pieces, wood, composite particulates, and combinations thereof.

8. The method of claim 1 wherein the first particulates comprise a degradable material.

9. The method of claim 8 wherein the degradable material comprises at least one material selected from the group consisting of a water-soluble material, a gas-soluble material, an oil-soluble material, a biodegradable material, a temperature degradable material, a solvent-degradable material, an acid-soluble material, an oxidizer-degradable material, and combinations thereof.

10. The method of claim 8 wherein the degradable material comprises at least one material selected from the group consisting of a dehydrated material, a wax, boric acid flakes, a degradable polymer, calcium carbonate, a paraffin, a crosslinked polymer gel, and combinations thereof.

11. The method of claim 8 wherein the degradable material comprises at least one material selected from the group consisting of a polyacrylic, a polyamide, a polyolefin, and combinations thereof.

12. The method of claim 8 wherein the degradable material comprises at least one material selected from the group consisting of a polysaccharide, a chitin, a chitosan, a protein, an aliphatic polyester, a poly(lactide), a poly(glycolide), a poly(ε-caprolactone), a poly(hydroxybutyrate), a poly(anhydride), an aliphatic polycarbonate, a poly(orthoester), a poly(amino acid), a poly(ethylene oxide), a polyphosphazene, a polyanhydride, and combinations thereof.

13. The method of claim 1 wherein the first particulates are coated with an adhesive substance.

14. The method of claim 13 wherein the adhesive substance comprises at least one material selected from the group consisting of a non-aqueous tackifying agent, an aqueous tackifying agent, a silyl-modified polyamide, a curable resin composition, and combinations thereof.

15. The method of claim 14 wherein the non-aqueous tackifying agent comprises at least one agent selected from the group consisting of a polyamide, a polyester, a polycarbonate, polycarbamate, a natural resins, and combinations thereof.

16. The method of claim 15 wherein the non-aqueous tackifying agent further comprises a multifunctional material.

17. The method of claim 14 wherein the aqueous tackifying agent comprises at least one agent selected from the group consisting of an acrylic acid polymer, an acrylic acid ester polymer, an acrylic acid derivative polymer, an acrylic acid homopolymer, an acrylic acid ester homopolymer, an acrylamido-methyl-propane sulfonate polymer, an acrylamido-methyl-propane sulfonate derivative polymer, an acrylamido-methyl-propane sulfonate co-polymer, an acrylic acid/acrylamido-methyl-propane sulfonate co-polymer, a copolymer thereof, and combinations thereof.

18. The method of claim 17 wherein the aqueous tackifying agent is made tacky through exposure to an activator, the activator comprising at least one activator selected from the group consisting of an organic acid, an anhydride of an organic acid, an inorganic acid, an inorganic salt, a charged surfactant, a charged polymer, and combinations thereof.

19. The method of claim 14 wherein the curable resin composition comprises at least one resin selected from the group consisting of a two component epoxy based resin, a novolak resin, a polyepoxide resin, a phenol-aldehyde resin, a urea-aldehyde resin, a urethane resin, a phenolic resin, a furan resin, a furan/furfuryl alcohol resin, a phenolic/latex resin, a phenol formaldehyde resin, a polyester resin, a hybrid polyester resin, copolymer polyester resin, a polyurethane resin, a hybrid polyurethane resin, a copolymer polyurethane resin, an acrylate resin, and combinations thereof.

20. The method of claim 1 wherein the at least one remedial perforation is created in an interval of the casing that was previously perforated.

21. The method of claim 1 wherein the perforating is bullet perforating, jet perforating, hydraulic jetting, or combinations thereof.

22. The method of claim 1 wherein the perforating comprises:

positioning a hydraulic jetting tool adjacent to the casing in a location adjacent to the production interval, and jetting a jetting fluid through the hydraulic jetting tool against the casing.

23. The method of claim 22 wherein the jetting fluid comprises a base fluid and sand.

24. The method of claim 23 wherein the sand is present in the jetting fluid in an amount of about 1 pound per gallon of the base fluid.

25. The method of claim 1 wherein the stimulating comprises introducing a fluid into the well bore and into the at least one remedial perforation so as to contact the production interval.

26. The method of claim 25 wherein the fluid is an ungelled aqueous fluid, an aqueous gel, a hydrocarbon-based gel, a foam, an emulsion, a viscoelastic surfactant gel, or combinations thereof.

27. The method of claim 25 wherein the fluid comprises an acid.

28. The method of claim 25 wherein the fluid comprises proppant.

29. The method of claim 25 wherein the introducing the fluid comprises pumping the fluid into the well bore and into the at least one remedial perforation at a pressure sufficient to create or enhance at least one fracture in the production interval.

30. The method of claim 1 wherein the stimulating comprises jetting a jetting fluid through a hydraulic jetting tool and into the at least one remedial perforation, wherein the hydraulic jetting tool is attached to a work string, wherein the hydraulic jetting tool is positioned adjacent to the at least one remedial perforation.

31. The method of claim 30 wherein the jetting creates or enhances at least one fracture in the production interval.

32. The method of claim 30 wherein the stimulating comprises introducing a fluid into the well bore down an annulus defined between the casing and the work string.

33. The method of claim 32 the fluid is introduced into the well bore simultaneously with the jetting of the jetting fluid.

34. The method of claim 1 further comprising perforating at least one remedial perforation in the casing adjacent to a second production interval.

35. The method of claim 34 wherein the stimulating further comprises stimulating the second production interval through the at least one perforation in the casing adjacent to the second production interval.

36. The method of claim 1 further comprising repeating the acts of perforating and stimulating for each of the remaining production intervals.

37. The method of claim 1 further comprising introducing a clean-out fluid into the well bore.

38. The method of claim 1 wherein the first particulates form a particulate pack in each of the plurality of perforations.

39. The method of claim 1 further comprising contacting the particulate packs with a second carrier fluid comprising second particulates so that the second particulates plug at least a portion of the interstitial spaces between the first particulates in the particulate pack.

40. The method of claim 39 wherein the average particle size of the second particulates is smaller than the average particle size of the first particulates.

41. The method of claim 39 wherein the second carrier fluid is an ungelled aqueous fluid, an aqueous gel, a hydrocarbon-based gel, a foam, a viscoelastic surfactant gel, or combinations thereof.

42. The method of claim 39 wherein the second particulates comprise at least one material selected from the group consisting of silica flour, sand, bauxite, ceramic materials, glass materials, polymer materials, fluoropolymer materials, nut shell pieces, seed shell pieces, cured resinous particulates comprising nut shell pieces, cured resinous particulates comprising seed shell pieces, fruit pit pieces, cured resinous particulates comprising fruit pit pieces, wood, composite particulates, and combinations thereof.

43. The method of claim 39 wherein the second particulates comprise degradable materials.

44. A method of stimulating a production interval adjacent a well bore having a casing disposed therein, the method comprising:

introducing a carrier fluid comprising first particulates into the well bore;

packing the first particulates into a plurality of perforations in the casing;

providing a hydraulic jetting tool having at least one port, the hydrajetting tool attached to a work string;

positioning the hydraulic jetting tool in the well bore adjacent the production interval;

jetting a jetting fluid through the at least one nozzle in the hydraulic jetting tool against the casing in the well bore so as to create at least one remedial perforation in the casing; and stimulating the production interval through the at least one remedial perforation.

45. The method of claim 44 wherein the first particulates have an average particle size in the range of from about 10 mesh to about 100 mesh.

46. The method of claim 44 wherein the first particulates are coated with an adhesive substance.

47. The method of claim 44 wherein the first particulates comprises a degradable material.

48. The method of claim 44 wherein the first particulates form a particulate pack in each of the plurality of perforations.

49. The method of claim 48 further comprising contacting the particulate pack in each of the plurality of perforations with a second carrier fluid comprising second particulates so that the second particulates plug at least a portion of the interstitial spaces between the first particulates in the particulate pack.

50. The method of claim 44 wherein the jetting fluid is an ungelled aqueous fluid, an aqueous gel, a hydrocarbon-based gel, a foam, a viscoelastic surfactant gel, or combinations thereof.

51. The method of claim 44 wherein the stimulating comprises introducing a stimulation fluid into an annulus so as to contact the at least one remedial perforation, the annulus is defined between the work string and the casing.

52. The method of claim 51 wherein the stimulation fluid is an ungelled aqueous fluid, an aqueous gel, a hydrocarbon-based gel, a foam, a viscoelastic surfactant gel, or combinations thereof.

53. The method of claim 51 wherein the stimulation fluid is introduced into the annulus at a pressure sufficient to create or enhance at least one fracture in the production interval.

54. The method of claim 51 wherein the stimulating comprises jetting a jetting fluid through the at least one nozzle in the hydraulic jetting tool, through the at least one remedial perforation, and against the production interval.

55. The method of claim 54 wherein the jetting the jetting fluid against the production interval and introducing the stimulation fluid into the annulus occur simultaneously.

56. The method of claim 54 wherein the jetting fluid is jetted against the production interval simultaneously with the introducing the stimulation fluid.

57. The method of claim 51 further comprising repeating the acts of positioning the hydraulic jetting tool, jetting the jetting fluid, and stimulating the production interval for each of the remaining production intervals.

58. A method of stimulating multiple production intervals adjacent a well bore having a casing disposed therein, the method comprising:

introducing a carrier fluid comprising first particulates into the well bore, packing the first particulates into a plurality of perforations in the casing, perforating at least one remedial perforation in the casing adjacent to a production interval, subsequent to the packing the first particulates, introducing a stimulation fluid into the well bore and into the at least one remedial perforation so as to contact the production interval, and repeating the acts of perforating at least one remedial perforation and introducing the stimulation fluid for each of the remaining production intervals.

59. The method of claim 58 further comprising contacting the packed perforations with a second carrier fluid comprising second particulates so that second particulates plug at least a portion of the interstitial spaces between the first particulates packed into the plurality of perforations.

* * * * *